US010407146B2

(12) United States Patent
Jones et al.

(10) Patent No.: US 10,407,146 B2
(45) Date of Patent: Sep. 10, 2019

(54) ONE-HANDED, FOREARM-BRACED PADDLE

(71) Applicants: Ray A. Jones, Lampe, MO (US); Ronna G. Haxby, Lampe, MO (US)

(72) Inventors: Ray A. Jones, Lampe, MO (US); Ronna G. Haxby, Lampe, MO (US)

( * ) Notice: Subject to any disclaimer, the term of this patent is extended or adjusted under 35 U.S.C. 154(b) by 197 days.

(21) Appl. No.: 15/645,193

(22) Filed: Jul. 10, 2017

(65) Prior Publication Data

US 2018/0050778 A1 Feb. 22, 2018

Related U.S. Application Data

(63) Continuation-in-part of application No. 15/422,964, filed on Feb. 2, 2017, now abandoned, which is a continuation of application No. 15/010,304, filed on Jan. 29, 2016, now abandoned, which is a continuation-in-part of application No. 13/854,540, filed on Apr. 1, 2013, now abandoned.

(60) Provisional application No. 61/686,111, filed on Mar. 31, 2012.

(51) Int. Cl.
*B63H 16/04* (2006.01)

(52) U.S. Cl.
CPC ..... *B63H 16/04* (2013.01)

(58) Field of Classification Search
CPC ..... B63H 16/04; A61F 4/00
USPC ..... 460/70 R; 16/430
See application file for complete search history.

(56) References Cited

U.S. PATENT DOCUMENTS

| | | | | |
|---|---|---|---|---|
| 545,706 | A | 9/1895 | Mannes | 416/63 |
| 969,528 | A * | 9/1910 | Disbrow | A47L 13/08 16/430 |
| 2,188,343 | A | 1/1940 | Flournoy | 416/63 |
| 2,745,119 | A | 5/1956 | Whipple | 441/56 |
| 2,893,021 | A | 7/1959 | Lundborg | 416/63 |
| D186,252 | S | 9/1959 | Roberts | D12/215 |
| 3,039,120 | A | 6/1962 | Powell et al. | 416/63 |
| 3,109,184 | A | 11/1963 | Moore | 416/63 |
| 3,153,797 | A | 10/1964 | Drennen | 416/63 |
| 3,407,419 | A | 10/1968 | Drummond | 441/56 |
| 3,518,024 | A | 6/1970 | Wilson | 416/63 |
| 4,233,925 | A | 11/1980 | Proctor | 440/101 |

(Continued)

OTHER PUBLICATIONS

Online store for product referred to as Riveraholic (TM) hand paddles, accessed online on Mar. 22, 2012, at riveraholic.com (3 sheets).

(Continued)

*Primary Examiner* — Mark A Laurenzi
*Assistant Examiner* — Paul W Thiede
(74) *Attorney, Agent, or Firm* — Jonathan A. Bay

(57) ABSTRACT

A one-handed, forearm-braced paddle has a blade at one end and a forearm brace at the other interconnected by a central shaft portion. The shaft has a rigid control handle that has a base end fixed to the shaft, and, extends from the shaft to a hand grip portion. The hand grip is shaped to allow a user to clench it, and is thereby radially spaced away from the shaft to further allow the user to apply longitudinal leverage on the blade, or else give the user leverage with the application of a twisting torque on the blade. The control handle is furthermore goose-necked shaped and arching away from the forearm brace so that the user's fingers are relatively unimpeded by any of the shaft, blade, or base portions of the control handle.

27 Claims, 23 Drawing Sheets

(56) References Cited

U.S. PATENT DOCUMENTS

| | | | | |
|---|---|---|---|---|
| 4,493,663 | A | 1/1985 | Richmond | 440/101 |
| 4,509,744 | A | 4/1985 | Beasley | 482/111 |
| 4,813,458 | A | 3/1989 | Jacobucci | 15/236.02 |
| 5,062,816 | A | 11/1991 | Berglund et al. | 440/101 |
| D353,573 | S | 12/1994 | Liveoak | D12/215 |
| 5,378,217 | A | 1/1995 | D'Orta | 482/111 |
| 5,379,758 | A * | 1/1995 | Snyder | A61B 17/02 15/143.1 |
| D363,458 | S | 10/1995 | Killen | D12/215 |
| 5,795,201 | A | 8/1998 | Tibbetts | 440/101 |
| 5,832,563 | A | 11/1998 | Simpson | 16/110.1 |
| 5,842,896 | A | 12/1998 | Liveoak | 441/56 |
| 5,954,074 | A | 9/1999 | Mattson | 135/68 |
| 6,398,603 | B1 | 6/2002 | Brown | 441/56 |
| 6,709,306 | B2 | 3/2004 | Brown | 441/56 |
| 7,311,573 | B1 | 12/2007 | Dillenschneider | 440/101 |
| 7,367,858 | B2 | 5/2008 | Matuska et al. | 440/101 |
| 7,950,975 | B1 * | 5/2011 | Chapman, Jr. | A63J 7/005 16/430 |
| 8,016,118 | B2 * | 9/2011 | Boll | E02F 3/02 209/417 |
| 2006/0174449 | A1 | 8/2006 | Hughes | 16/430 |
| 2013/0039776 | A1 | 2/2013 | Adams | 416/70 R |

OTHER PUBLICATIONS

Online store for product referred to as Praddel (TM) compact paddle, accessed online on Mar. 22, 2012, at apsltd.com/c-2790-praddel-comapact-hand-paddle.aspx (1 sheet).

Online store for product referred to as Finis (TM) paddles, accessed onine on Mar. 22, 2012, at finisinc.com (2 sheets).

Online store for product referred to as Backwater Hand Paddles (TM), accessed online on Mar. 22, 2012, at backwaterpaddles.com (2 sheets).

Online store for product referred to as Chosen Valley Creating Ability one arm paddle, accessed online on Mar. 22, 2012, at creatingability.com/hand.html.

Article entitled, "How a Paddle Works," accessed online on Jan. 29, 2016, at http://www.guillemot-kayaks.com/guillemot/information/kayak_design/how_a_paddle_works.

* cited by examiner

ONE-HANDED, FOREARM-BRACED PADDLE

CROSS-REFERENCE TO RELATED APPLICATION(S)

This application is a continuation-in-part of U.S. patent application Ser. No. 15/422,964, filed Feb. 2, 2017; which is a continuation Ser. No. 15/010,304, filed Jan. 29, 2016; which is a continuation-in-part of U.S. patent application Ser. No. 13/854,540, filed Apr. 1, 2013; which claims the benefit of U.S. Provisional Application No. 61/686,111, filed Mar. 31, 2012. The foregoing patent disclosures are incorporated herein by this reference thereto.

BACKGROUND AND SUMMARY OF THE INVENTION

The invention relates to marine propulsion and, more particularly, to paddles. Alternatively, the invention relates to fluid reaction surfaces and, more particularly, to body supported fluid reaction surfaces that have carrying handles.

In still further alternative terminology, the invention relates to watercraft paddles, as for kayaks or canoes and the like, configured so that a user can handle the paddle by one hand, and easily paddle the watercraft that way: —i.e., by one hand.

It is an aspect of the invention that the one-handed paddle in accordance with the invention has a forearm brace.

It is a further aspect of the invention that this forearm brace is configured and/or oriented for sustaining pressure applied to it from the anatomical posterior aspect of the user's forearm. Hence the forearm brace does not brace the user.

To the contrary, it is the other way around. The user's forearm bears against the forearm brace to apply pressure (or force) to the paddle.

It is an additional aspect of the invention that the one-handed paddle in accordance with the invention has a control handle in combination with the forearm brace. That way, the control handle can serve in the role as a fulcrum between the forearm brace and the paddle blade. Thus paddle strokes can be more efficiently performed with less shoulder than with conventional, prior art two-handed paddles. With the inventive paddle, one means of performing a paddle stroke is an about the same manner as if you were standing on land, had a baseball in your hand, and you threw the baseball behind you, releasing the baseball at an elevation below or level with your waist. If you were sitting in a kayak and did this motion with the one-handed, forearm-braced paddle in accordance with the invention, the following would happen. The user's forearm would thrust the paddle's forearm brace in a forward and perhaps slightly downward trajectory. The user's grip on the paddle's control handle would thrust the control handle on an arc in a rearward and downward trajectory. The result is a rearward sweep of the paddle's blade.

If the input torque (in a—more or less—vertical plane, that contains the sweep of the blade) is reckoned as the thrust of the user's forearm, the output torque can be reckoned as the sweep of the paddle's blade. The fulcrum between the input torque and output torque is some perpendicular axis therebetween associated with the control handle.

Pause can be taken to briefly change the subject regarding the matter of paddles and refer for a moment to internal combustion engines. In the matter of internal combustion engines, there are two relative performance factors to contrast. There is power, and then, there is torque. Small compact gasoline engines are notable for developing high horsepower ratings: —if such engines can rev at high enough speeds (i.e., RPM's). In contrast, relatively more massive and bulky diesel engines are just as notable for not being able to produce very high horsepower ratings, but instead, being able to produce a lot of torque. The one-handed paddle in accordance with the invention is a high torque paddle.

A number of additional features and objects will be apparent in connection with the following discussion of preferred embodiments and examples.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
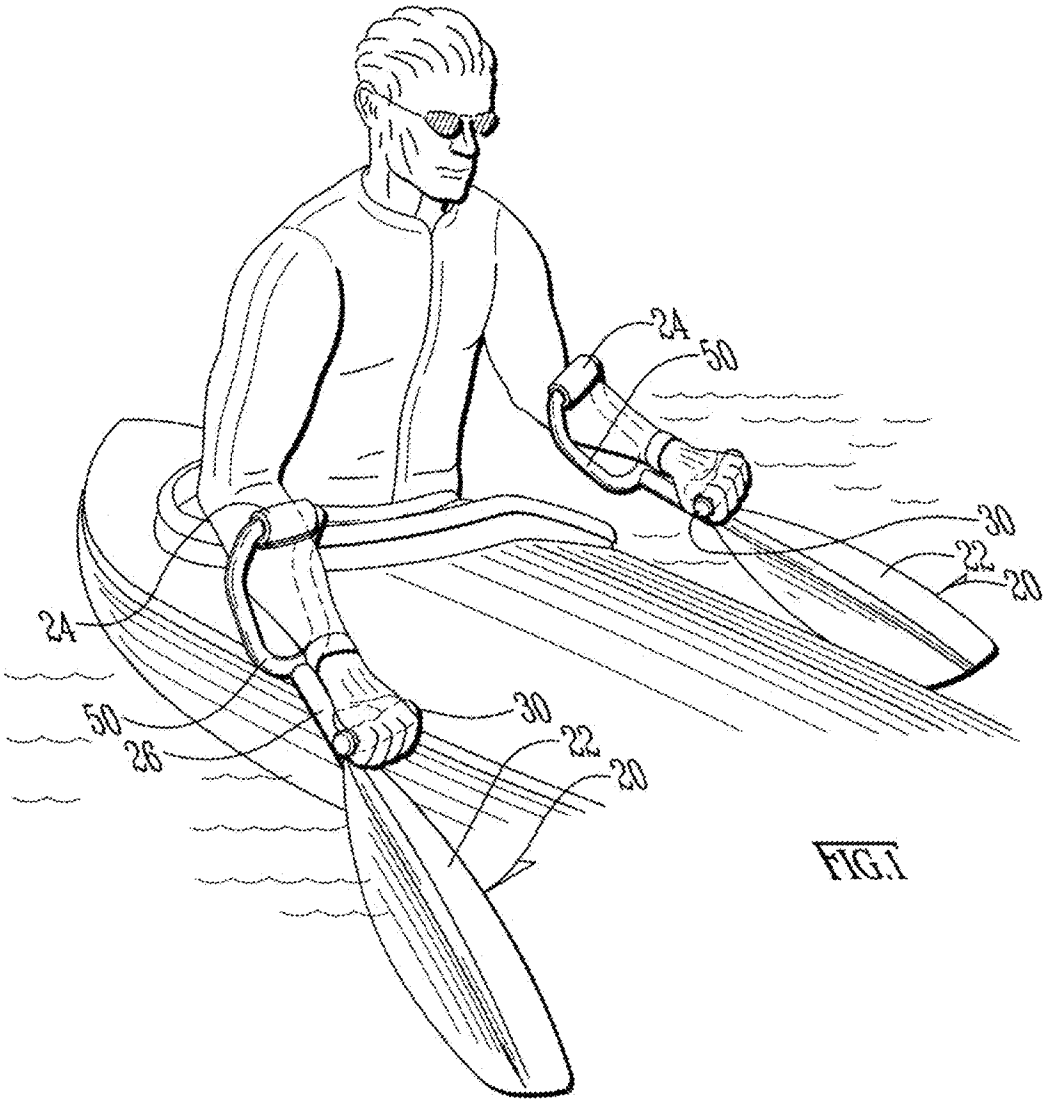
FIG. 1 is a perspective view of a one-handed, forearm-braced paddle in accordance with the invention, wherein a user is shown paddling a kayak for example and without limitation as an exemplary operative use environment.

Since multiple aspects of the invention relate to contrasts among various planes and axes, a preliminary introduction on how the invention is disclosed herein (mutually by the text and the drawings) is given next and refers to the manner illustrating planes and angles.

The seven (7) basic engineering drawing views consist of an imaginary transparent cube enclosing an object and the then illustrating the object on the basis of a perspective and then the six sides of the cubes, which seven (7) views are typically referred to as follows: — perspective,
front elevation,
rear elevation,
left side elevation,
right side elevation,
top plan, and
bottom plan.

Again, words, the object to be illustrated is imaginarily suspended in the middle of an imaginary transparent cube, and is traditionally drawn with one perspective and then by the six faces of the cube.

Regarding illustrating planes and axes, let's begin the discussion with axes. If a left-to-right axis is shown in any of: — the front elevation view,
the rear elevation view,
the top plan view, or
the bottom plan view, then the axis will appear as a straight line.

If the left-to-right axis is shown in either of: — the left side elevation,
the right side elevation, then the axis will appear a point.

Now let's compare planes. If a horizontal plane is shown in either of: — the top plan view, or
the bottom plan view, then that plane will actually be a flat web to the view except, if there is no surface shading, the plane will be invisible. Which is not a loss of opportunity to illustrate the plane because, the elevation of the plane through the object would be impossible to discern.

If that horizontal plane is shown in any of: — the front elevation view,
the rear elevation view,
the left side elevation view, or
the right side elevation view, then that plane will appear as a line.

Now to go further, let's extend that left-to-right axis through the horizontal plane. It is conventional to say that, the left-to-right axis is "contained" in that plane.

If that horizontal plane and that left-to-right axis "contained" in that plane are shown in either of: — the top plan view, or
the bottom plan view, then the axis will appear as a line but again the plane will actually be a flat web to the view and again, without surface shading, the plane will be invisible. Which again is no loss of opportunity to illustrate the plane, because the elevation of the plane through the object would be impossible to discern.

If that horizontal plane and that left-to-right axis "contained" in that plane are shown in either of: — the left side elevation view, or
the right side elevation view, then the plane will appear as a line but the axis will appear as a point on that line.

If that horizontal plane and that left-to-right axis "contained" in that plane are shown in either of: — the front elevation view, or
the rear elevation view, then that plane and also that axis will appear as a line:—the exact same line.

In fact every axis contained in that plane—except for front to back axes—will appear as the same line as the plane.

Therefore, it is correct—in certain views—to give one line both a reference numeral for a plane and another (or more) reference numerals for axes contained in that plane (and which do not extend straight into and away from the view).

Perhaps it is better to disentangle any doubt of questions over plane vs. axes by referring to the perspective views herein.

FIG. 1 shows a pair of one-handed, forearm-braced paddles 20 in accordance with the invention being utilized by a user (a paddler) to propel a kayak or like watercraft (that is, like canoes and so on).

Briefly, the paddle 20 comprises a blade 22 at one end, a forearm brace 24 at the other, with the blade 22 and forearm brace 24 being interconnected by a central shaft, or, stem portion 26. The stem portion 26 along with the framing 50 (see FIGS. 2 through 4) for the forearm brace 24 represents a transitional structure (e.g., 26,50) between the blade 22 and forearm brace 24.

The stem portion 26 may be configured, not as a single shaft but, as a frame (not shown). In fact, the stem portion 26 may be a continuation of the same frame of the framing 50 of the forearm brace 24.

The one-handed, forearm-braced paddle 20 in accordance with the invention moreover includes an inventive control handle 30 that provides the user with longitudinal leverage on the blade 22. The control handle 30 extends out of a connection with the transitional structure (that is, stem 26 and framing 50 in FIGS. 2 through 4). The connection between the control handle 30 and the transitional structure (stem 26 and framing 50 in FIGS. 2-4) serves as fulcrum between the forearm brace 24 and blade 22. The user can generate substantial leverage (torque) about the fulcrum by performing a paddle stroke as follows.

Imagine the paddler not paddling but standing on land, holding a baseball in his or her throwing hand, and then throwing the baseball forcibly behind him or herself, releasing the baseball at an elevation below or level with his or her waist. The paddler would probably do this with the throwing arm bent. The upper arm would probably point straight out to the side from the shoulder. The forearm would swing in a arc below the elbow, from front to back.

When the paddler sits in his or her watercraft and does about this same motion with the one-handed, forearm-braced paddle 20 in accordance with the invention, the following would happen.

The user's forearm would thrust the paddle's forearm brace 24 in a forward and perhaps slightly downward trajectory. The user's grip on the paddle's control handle 30 would thrust the control handle 30 on an arc in a rearward and downward trajectory. The result is a rearward sweep of the paddle 20's blade 22.

The control handle 30 furthermore allows the user to twist the blade 22. Indeed, the user can twist the blade 22 to face forwardly, and then do a backwards paddle stroke, somewhat simulating the motion on land of a softball pitcher pitching underhand.

Pause can be taken for a moment to consider the relative position of things, not only for the paddle 20 but also for the human anatomy of a forearm.

Anatomists standardized the naming of the relative position of human body parts by reference to a standard pose, or, to what anatomists refer to as the "anatomical position." Among other specifics, a person in the 'anatomical position' is standing up straight, with arms at the sides and palms facing forwards (with the fingers extended).

Figure 2:
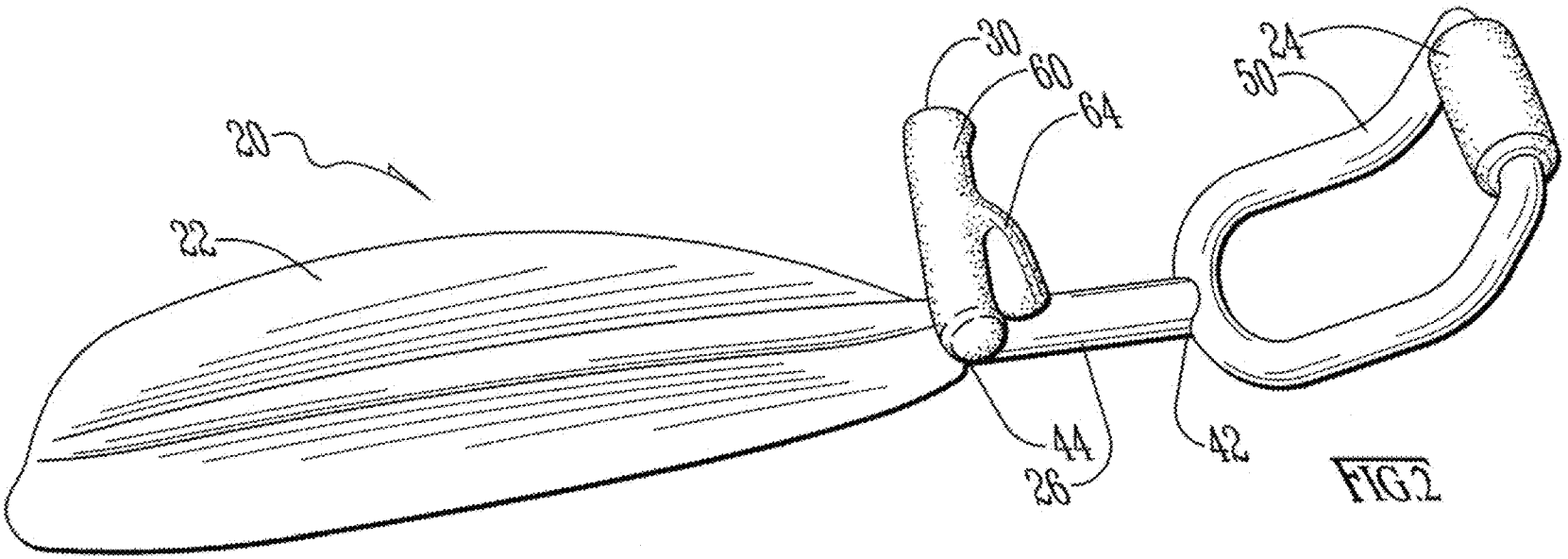
FIG. 2 is an enlarged scale perspective view of a posterior aspect of the paddle of FIG. 1.
Figure 2B:
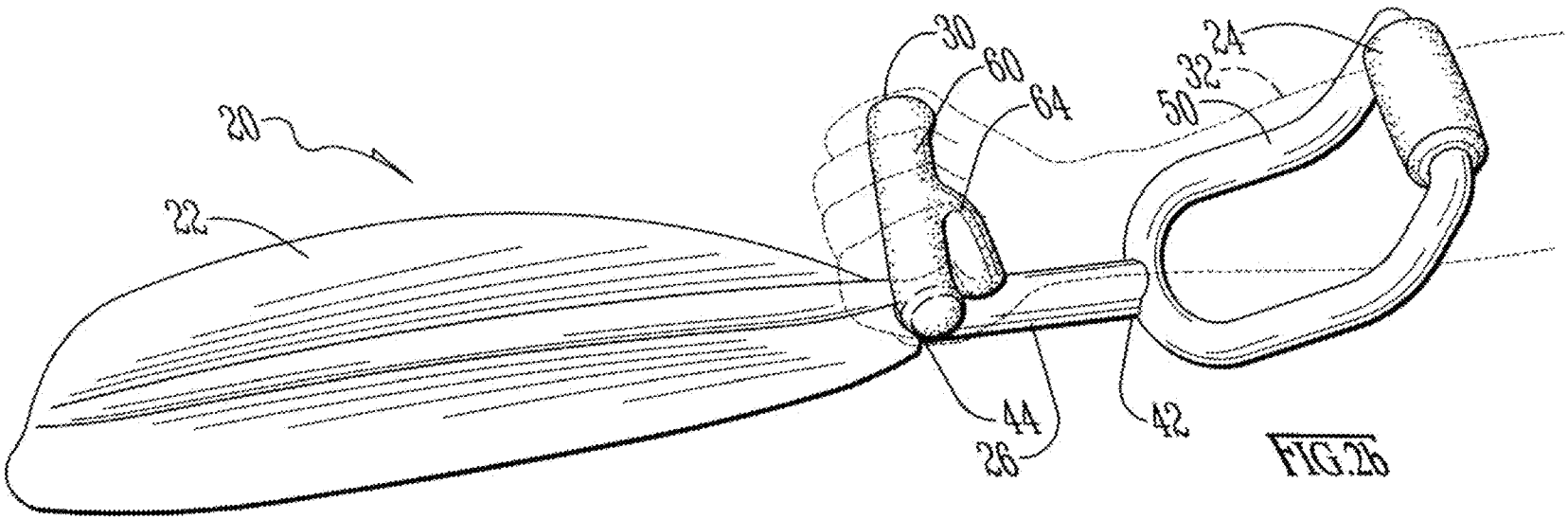
FIG. 2*b* is a perspective view comparable to FIG. 2 except including an outline in dashed lines of a user's forearm in order to shown one scale of preferred proportions between the paddle and a user's forearm.
Figure 4:
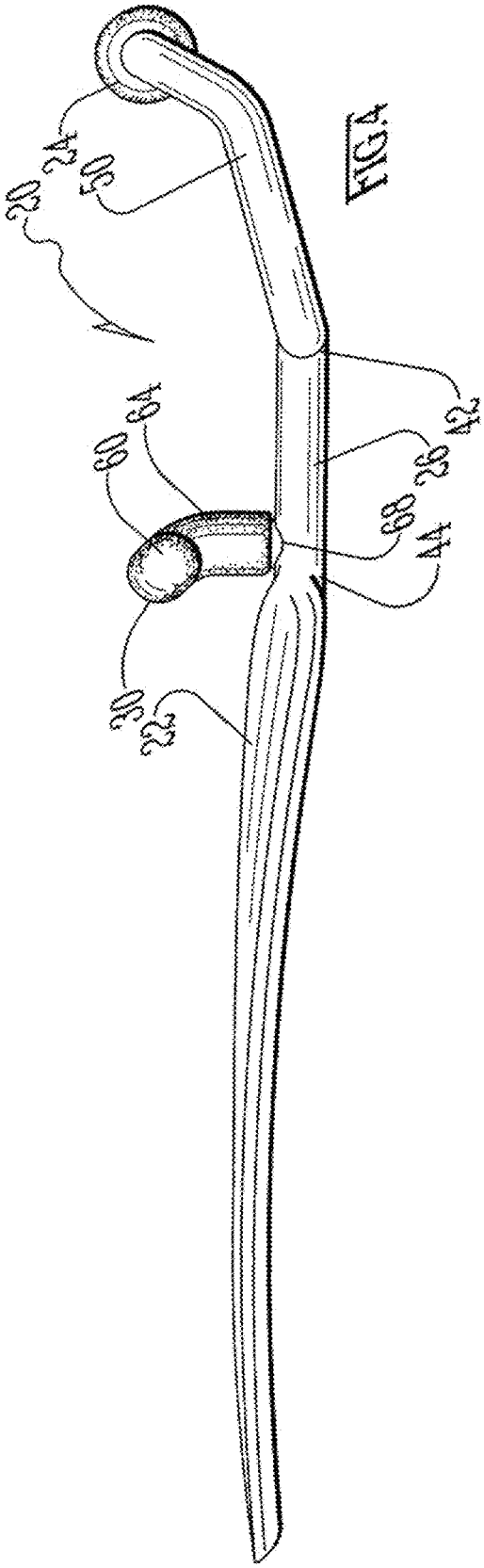
FIG. 4 is a side elevational view of FIG. 3.
Figure 4B:
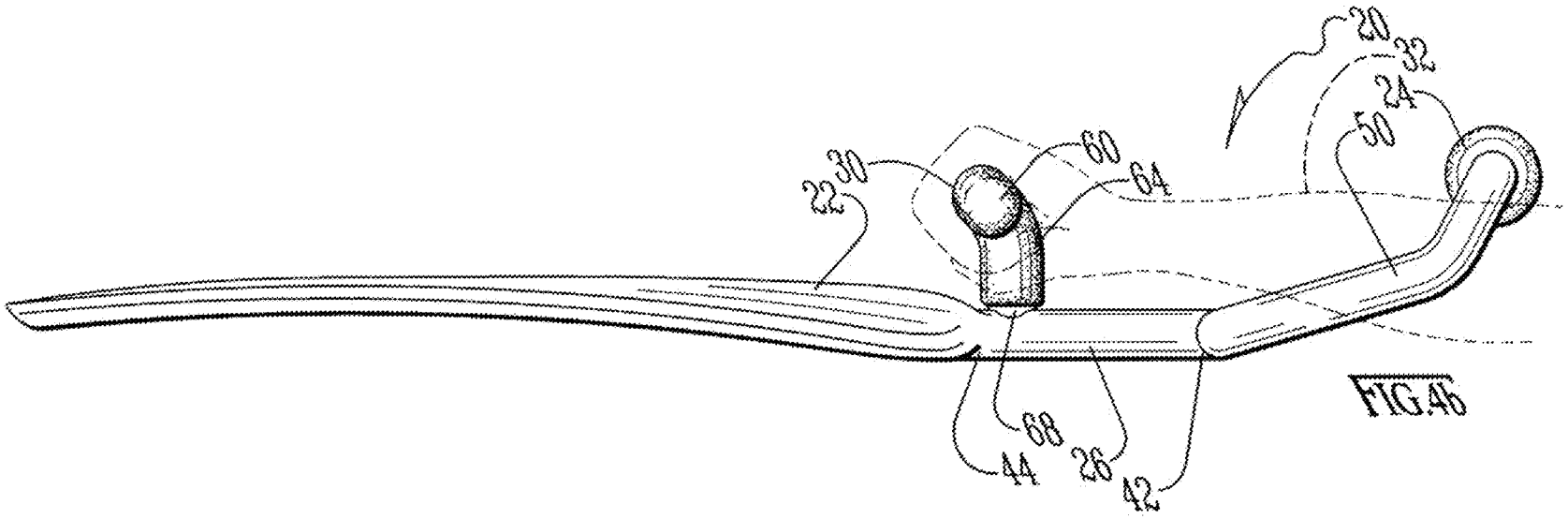
FIG. 4*b* is a side elevational view comparable to FIG. 4 except including an outline in dashed lines of a user's forearm in order to shown one scale of preferred proportions between the paddle and a user's forearm.

Accordingly, as FIGS. 2*b* and 4*b* show better, the forearm brace 24 in accordance with the invention rests over what anatomy considers to be the posterior aspect of the forearm 32.

"Posterior" refers to the rear or backside. "Aspect" defines a side or surface facing in a particular direction: —e.g., the posterior aspect of the body is the backside. Evidently, in anatomy, the term 'aspect' is preferred over the synonym 'side.'

Hence in anatomy, "posterior" refers to the rear of human body parts in the 'anatomical position,' while "anterior" refers to the front, "lateral" to the outer sides, and "medial" to the parts which have inner sides.

Thus, as FIGS. 2*b* and 4*b* show better, the forearm brace 24 technically rests over the posterior aspect of the forearm 32, even though when the user is paddling a watercraft forward, the forearm brace 24 actually faces forward as well too.

The anatomical anterior (e.g., front) aspect of the forearm might commonly be thought of as the belly. The anatomical lateral (e.g., outer) aspect of the forearm runs up the forearm from the thumb. The anatomical medial (e.g., inner) aspect of the forearm runs up the forearm from the little finger.

The one-handed, forearm-braced paddle 20 in accordance with the invention comprises a stem portion—and/or some manner of transitional structure 26 and 50—flanked between a blade 22 and forearm brace 24.

Figure 6:
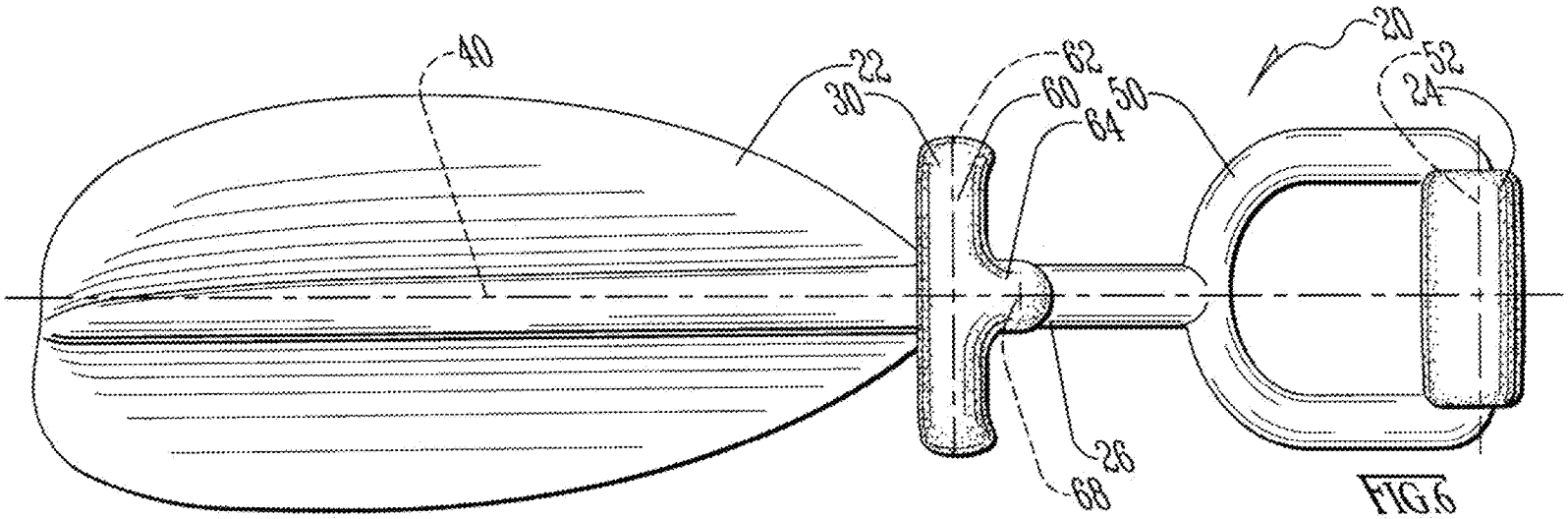
Figure 7:
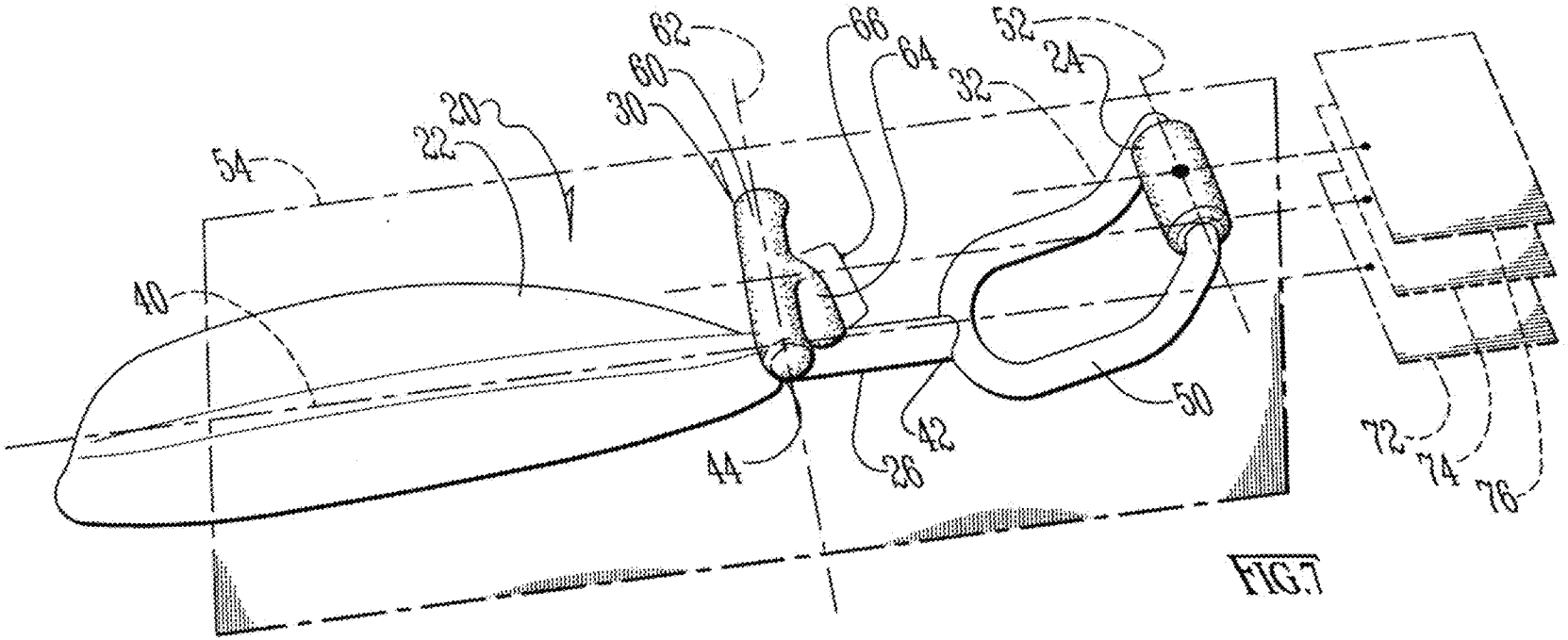
FIG. 7 is a perspective view comparable to FIG. 2 except showing the relative spacings among and/or intersections between the various reference planes containing certain components of the paddle in accordance with the invention, or else defining or partitioning various portions of the paddle in accordance with the invention into various regions.

The stem portion 26 is elongated along a main axis 40 and extends between a proximal transition 42 and a spaced distal transition 44. FIGS. 6 and 7 are better at showing the main axis 40, and that, these 'transitions' 42 and 44 may or may not be actual ends. Again, the stem portion 26 may be configured, not as a single shaft, but a frame of two spaced side rails, or a central shaft flanked by a pair of outer struts, and so on. The blade 22 is attached to and/or extends from this stem portion 26 at the distal transition 44 thereof. Preferably the blade 22 is removable and is replaceable with blades of various other designs (not shown).

The forearm brace 24 is oriented for sustaining pressure applied to it from the anatomical posterior aspect of the forearm 32 (see, for example, FIGS. 2*b*, 4*b* and/or 7). Hence the forearm brace 24 does not brace the user, rather, it is the other way around. The user's forearm bears against the forearm brace 24 to apply pressure (or force) to the paddle 20.

The forearm brace 24 is interconnected to the proximal transition 42 of the stem portion 26 by rigid framing 50. This rigid framing 50 has a base end that extends out of the stem portion 26's proximal transition 42, and extends along the user's forearm. The stem portion 26 and rigid framing 50 together can be reckoned as a unified transitional structure 26 and 50.

FIGS. 6 and 7 show better that the forearm brace 24 is elongated along a transverse axis 52 generally transverse to the main axis 40. The forearm brace 24 may be arched (or not) for comfort of the user. Moreover, the blade 22 has plane 54 generally slicing through a center of geometry of the blade 22. That is, the plane 54 generally slicing through a center of geometry of the blade 22 generally: — contains the main axis 40, partitions the blade 22 between inboard and outboard halves, and intersects the transverse axis 52 at a right angle.

FIGS. 2*b*, 4*b* and 7 show better that the framing 50 is sized and arranged to dispose the forearm brace 24 intermediate between the user's wrist and elbow while the user clenches the control handle 30. Generally, locating the forearm brace 24 closer to the elbow (further from the wrist) provides the user with more leverage. Which is a good result, except that, locating the forearm brace 24 too high up the forearm will impede the user's ability to flex his or her arm, especially if wearing thick (and relatively restrictive) neoprene garments or the like for cold weather paddling.

The framing 50 may be asymmetric and configured to comprise a single side rail extending along either the anatomical lateral aspect of the user's forearm or the anatomical medial aspect of the user's forearm (not shown). However, it is preferred in accordance with the invention to arrange the framing 50 to be symmetric, and to comprise a pair of spaced side rails that extend along both the anatomical lateral aspect of the user's forearm and the anatomical medial aspect of the user's forearm, respectively (as shown).

The control handle 30 comprises a gooseneck T-shape having a hand grip portion 60 that is preferably elongated along a grip axis 62 arranged generally transverse to the main axis 40, and, further having a lever arm portion 64.

The FIGURES may have reference numeral 30 (indicating the control handle) pointing to structure also indicated by either reference numeral 60 (indicating the hand grip) or else indicated by reference numeral 64 (indicating the goose-necked lever arm). But that is because the control handle 30 comprises both the hand grip 60 and lever arm 64. Hence reference numeral 30 (indicating the control handle) has to point to one or the other of the hand grip 60 or lever arm 64.

The lever arm 64 is elongated and extends between a base end 68 anchored in the stem portion 26 of the paddle 20, and, a terminal end affixed to and forming a T-intersection with the hand grip 60. FIGS. 1-7 have the lever arm indicated as reference numeral 64. The lever arm 64 is preferably curved, and arches radially out from the stem portion 26 of the paddle 20, at the same time as arching longitudinally away from the forearm brace 24.

Hence the curve or arch in the lever arm 64 gives the control handle 30 the 'gooseneck' shape in the paddle 20 or FIGS. 1-7. The control handle 30 and the hand grip 60 are not the same thing. The control handle 30 comprises not only the hand grip 60 but also the lever arm 64 as well.

Figure 3:
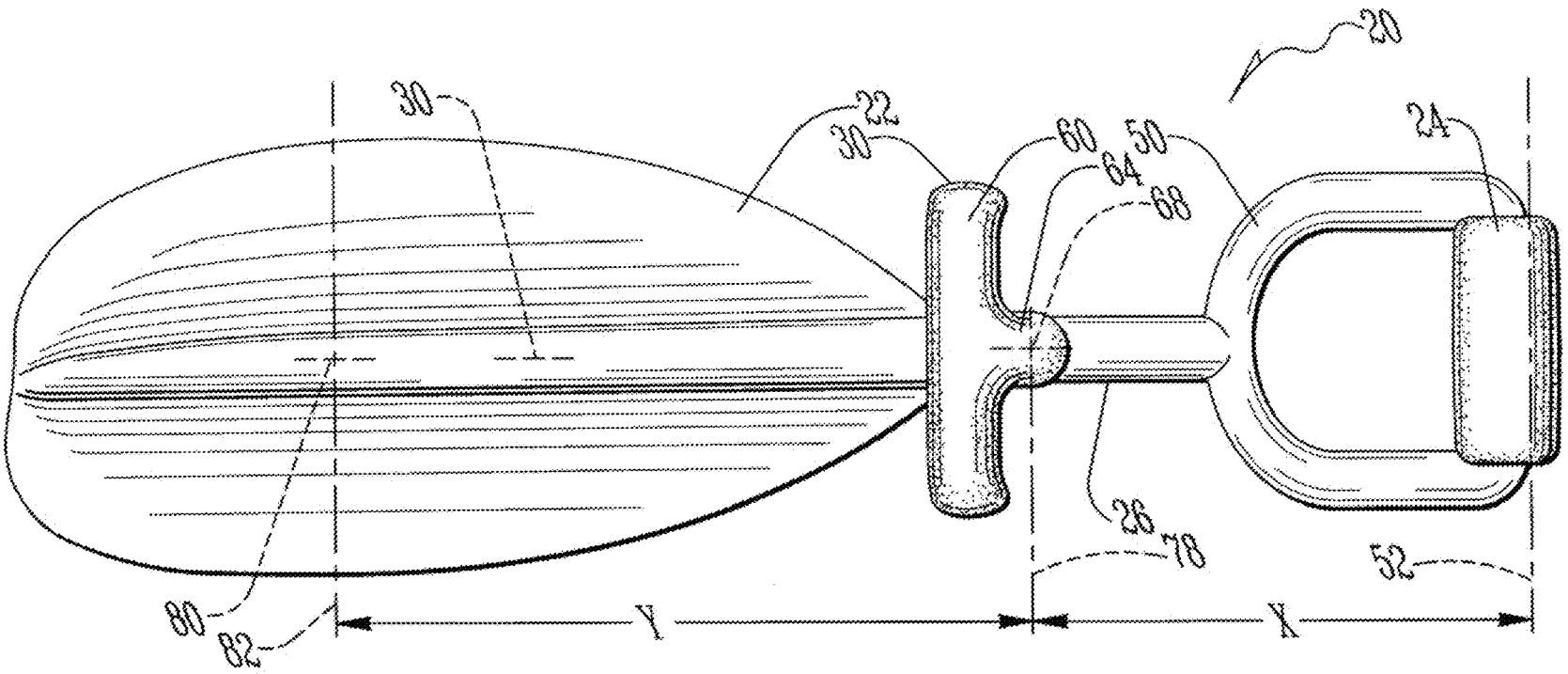
FIG. 3 is a plan view of the posterior aspect shown by FIG. 2.

The hand grip 60 neither needs to be truly cylindrical nor truly linear. The hand grip 60 might have a bend near one end. The bend might result in a back sweep (as shown in FIG. 3) or droop at that end (as shown in FIG. 4), or do a little of both (as shown in FIG. 2). The hand grip 60 might have bends (and which is shown by FIGS. 2 and 3).

Once again, the control handle 30 comprises the hand grip 60 and the lever arm 64 which interconnects the hand grip 60 with the stem portion 26. The lever arm 64 has a base end 68 that extends out of the stem portion 26. The lever arm 64 terminates in the hand grip 60. The base end 68 for the lever arm 64 might alternatively be anchored anywhere in the transitional structure (that is, the stem 26 and the framing 50 in FIGS. 2 through 4). But preferably the base end 68 for the lever arm 64 is located on the stem portion 26 of the paddle 20, somewhere between and/or including the proximal transition 42 and the distal transition 44.

The base end 68 of the lever arm 64 serves as the fulcrum for the paddle 20. During a paddle stroke, plane 54 would contain the sweep of the blade 22 (and would be more or less vertical plane. Given the foregoing, in plane 54, there are two torque inputs that are transmitted to the base end/fulcrum 68 of the paddle 20. One, there is thrust from the user's forearm as applied to the forearm brace 24. Two, there is thrust from the user's clenched hand on the hand grip 60.

In contrast, there is one torque output that is transmitted out of the base end/fulcrum 68 of the paddle 20. And that torque output is, the sweep of the blade 22 through the water.

Figure 5:
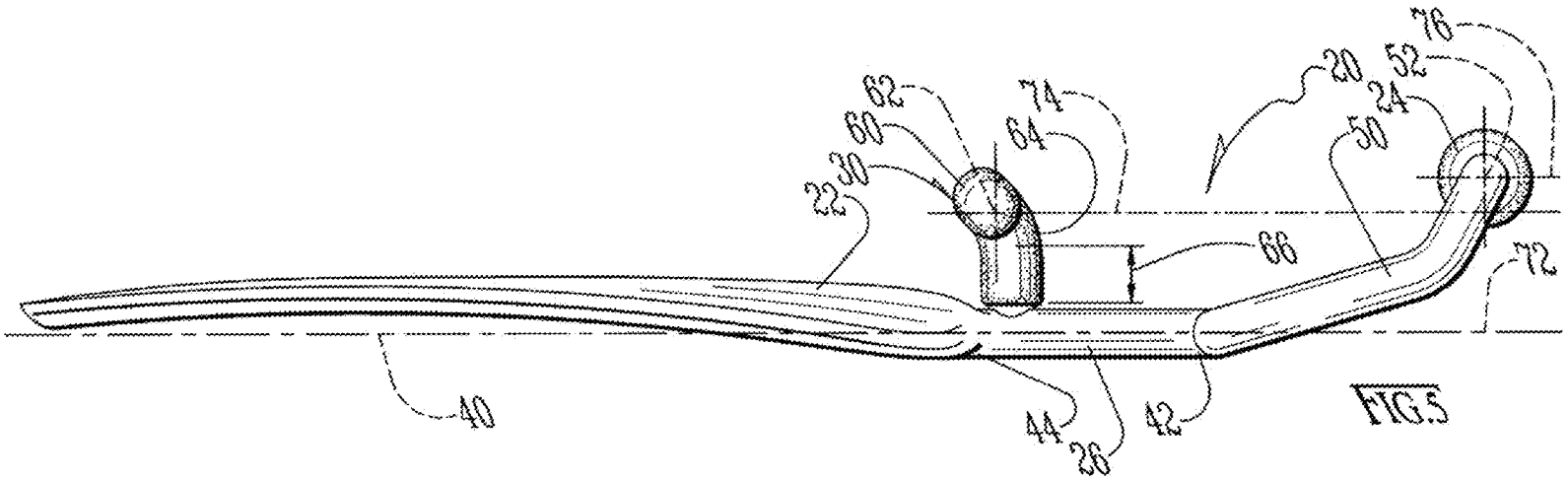
FIGS. 5 and 6 are a side elevational view (i.e., that associated with FIG. 5) and a plan view (i.e., that associated with FIG. 6), comparable to FIGS. 4 and 3 respectively, except on a reduced scale and on a single drawing sheet in order to show relations among orthogonal planes and axes.

FIG. 5 shows better that, the lever arm 64 is shaped and arranged to support the hand grip 60 radially spaced away from the main axis 40 such that the user's clenched grasp on the hand grip 60 is spaced off the stem portion 26.

The hand grip 60 is sized to allow the user to coil fingers and thumb around it (see, e.g., FIGS. 16-22). The hand grip 60 and lever arm 64 are cooperatively sized and arranged to provide a gap 66 over the stem portion 26 (and/or those portions of the blade 22 which are proximate the distal transition 44 of the stem portion 26). Indeed, this gap 66 is preferably sized to provide clearance for the user's fingers to coil around the hand grip 60, without impedance from the stem portion 26 or blade 22, even while wearing thick gloves (see, e.g., FIG. 22).

FIGS. 5 and 6 show better that the blade 22 comprises a "leaf-shaped" expansion extending from the distal transition 44 of the stem portion 26. Again, preferably the blade 22 is interchangeable. There are nearly infinite designs for blades. But most are panel shaped in one sense or another such that referring to blades as "leaf shaped" is adequate for present purposes.

Figure 8:
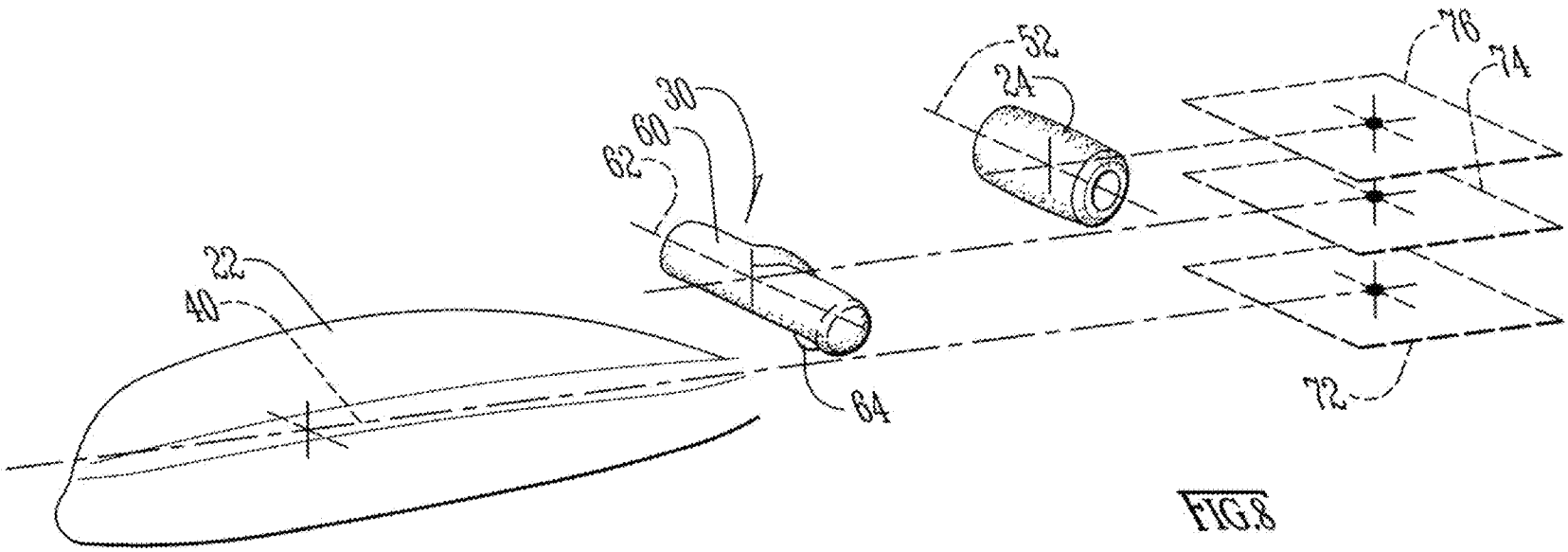
FIG. 8 is a perspective view comparable to FIG. 7 except portions broken away to better show the relationship of the blade, hand grip and forearm brace being located in spaced parallel planes relative to each other.

FIGS. 5 and 7-8 show that, preferably the blade 22 is relatively planar relative to a 'coronal' plane 72 containing the main axis 40. The term 'coronal' comes again from anatomy. In anatomy, a 'coronal plane' is any vertical plane that divides a body into ventral and dorsal (belly and back) sections.

In FIG. 5, reference numeral 72 (indicating the coronal plane) and reference numeral 40 (indicating the main axis) point the same line, because that line represents both the coronal plane 72 and main axis 40. Again, the plane 72 is being viewed along an edge, and hence appears as a line. The main axis 40 is contained in the plane 72 (and does not extend straight into or out of the view) and hence appears as the same line.

Also in FIG. 5, reference numeral 52 (indicating the transverse axis) and reference numeral 62 (indicating the grip axis) point to center points. This is because both the transverse axis 52 and center axis 62 extend straight into (and correspondingly straight out of) the view and hence both do appear only as center points.

Many blades are flat. But most specific purpose blades are not actually flat, and hence have a carefully designed hydrodynamic shape (e.g., warped shape). If warped, the warp shape has either coincidence with or divergence away from the coronal plane 72 over the expansion of the blade 22. However, the divergence away from the coronal plane 72 is minor relative to the leaf-shaped expansion of the blade 22 from the stem portion 26.

Referring to FIG. 7, the coronal plane 72 contains the main axis 40. In fact, the main axis 40 corresponds to the intersection between the coronal plane 72 and the plane 54 of the center of geometry of the blade 22. Also, the coronal plane 72 and the plane 54 of the center of geometry of the blade 22 are perpendicular to each other.

FIGS. 7-8 show that the grip axis 62 is contained in a plane 74 parallel to and spaced away from the coronal plane 72. The Hence the grip axis 62 of the hand grip 60 is not only radially spaced away from the main axis 40 but is spaced from the coronal plane 72 as well. The more significant purpose of this spacing between the coronal plane 72 and grip axis 62 is to provide the user with a leverage over the blade 22, both with longitudinal leverage (e.g., driving the blade through water as a lever about the base end/fulcrum 68 of the paddle 20) as well as with twisting leverage.

FIGS. 5 and 7 also shows the following. The control handle 30's lever arm 64 spaces the hand grip 60 from the coronal plane 72 such that the grip axis 62 therefor is contained in a spaced away, parallel plane 74.

Similarly, the framing 50 spaces the forearm brace 24 further out from the coronal plane 72 such that the transverse axis 52 therefor is contained in another spaced away but parallel plane 76.

With the paddle shown in the orientation as shown in FIGS. 7-8, the planes 72, 74 and 76 are all parallel to each other, as well spaced from each, and stack up in the following order. The coronal plane 72 which contains the main axis 40 is the reference coronal plane 72 of the blade, and is the main reference plane 72 for the other two planes 74 and 76. Plane 76 which contains the transverse axis 52 of the forearm brace 24 is further away, or further out, from the coronal plane 72 than the plane 74 which contains the grip axis 62 of the hand grip 60. Hence plane 76 can be referred to as the outer plane 76. Plane 74 can be referred to as the intermediate plane 74.

Given the foregoing, the following distances can be compared to each other, as measured along axes perpendicular to all three planes 72, 74 and 76. The distance for the forearm brace 24 between the main axis 40 and transverse axis 52 is equal to or greater than the distance for the hand grip 60 between the main axis 40 and grip axis 62. That way, the user's forearm is disposed nearly parallel to or closer to being parallel with the main axis 40 than if the forearm brace 24 were disposed in the main axis 40 (which it is not).

It is more preferred still if the distance for the forearm brace 24 between the main axis 40 and transverse axis 52 is greater than the distance for the hand grip 60 between the main axis 40 and grip axis 62.

In alternative language, the control handle (30)'s lever arm (64) supports the hand grip (60) such that the grip axis (62) is radially spaced away from the main axis (40) along one radially perpendicular distance perpendicular to the coronal plane (72); and, the framing (50) is arranged to support the forearm brace (24) such that the transverse axis (52) for the forearm brace (24) is radially spaced away from the main axis (40) along another radially perpendicular distance perpendicular to the coronal plane (72). Wherein said one radially perpendicular distance between the main axis (40) and the grip axis (62) is at least ninety to eighty percent less than said other radially perpendicular distance between the main axis (40) and transverse axis. The drawings show that the radially perpendicular distance between the main axis (40) and the grip axis (62) is about seventy-two percent of the radially perpendicular distance between the main axis (40) and transverse axis.

It is an aspect of the invention that the control handle 30 inventively provides the user with leverage over the blade 22, including longitudinal leverage on the blade 22 as well as leverage with twisting the blade 22. The lever arm 64 is furthermore goose-necked shaped or otherwise arranged to provide clearance by a gap 66 for the user's fingers and thumb such that the user's clenched grasp on the hand grip 60 is relatively unimpeded by any of the stem portion 26, blade 22, or base portion 68 of the lever arm 64. See, e.g., FIGS. 16-21. And preferably the lever arm 64 and hand grip 60 are sized and arranged this way even for users wearing thick gloves for cold weather paddling. See, e.g., FIG. 22.

FIG. 3 shows one further matter regarding the paddle 20 in accordance with the invention. In simplest terms, this paddle 20 is a short, or stubby paddle.

In more technical terms, this paddle is characterized by a length "X" and another length "Y" which are related to each other by the following expression:

$$Y=1 \text{ to } 3 \text{ times } X. \quad (1)$$

That is, the length "Y" is between one and three times the length "X."

The paddle 20 in accordance with the invention can be reckoned as a simple Class One Lever. That is, the 'effort' is on the other side of the 'fulcrum' than the load.

To diverge for a moment to consider a long-shafted conventional canoe paddle, there is a good bit of debate over what proper lever classification to assign to the paddling motion as whole for such a long-shafted conventional canoe paddle. Some analysis says the lever includes the paddler as well as the paddle, and thus the lever is a Class Three Lever (that, the 'effort' is between the 'fulcrum' and 'load'). By this analysis for a long-shafted conventional canoe paddle, the 'fulcrum' is some imaginary point in the sky above the paddler's shoulder. The 'effort' is between the paddler's hands. The 'load' can be represented by a vector from a single point in the paddle blade. If the paddle blade is stiff and moved linearly perpendicularly through still water, that point is reckoned as the 'geometric center of mass' of the water on the power face of the blade.

To return to the paddle 20 in accordance with the invention, it can be reckoned on its own terms—and ignoring the overall paddling motion—as a Class One Lever. FIG. 3 shows the apparent fulcrum point 68 for the paddle 20. Again, the fulcrum 68 corresponds to base end 68 of the lever arm 64 of the control 30. The base end 68 is where the lever arm 64 is connected to the stem portion 26. Again, FIG. 3 is a plan view of the posterior aspect of paddle 20. The main axis 40 is contained in the coronal plane (not indicated in FIG. 3). The fulcrum 68 is probably close to being but is probably not exactly contained in the coronal plane (again, not indicated in FIG. 3).

Staying in FIG. 3, the fulcrum 68 locates a fulcrum axis 78 which, when viewed in this plan view, is perpendicular to the main axis 40. The blade 22 has a 'geometric center of mass' 80, which is where a theoretical vector of 'load' would emanate from the blade 22 if the blade is stiff and moved linearly perpendicularly through still water.

Here is another way to imagine the geometric center of mass 80. To begin with, the geometric center of mass 80 is a property of the object which is the 'load,' which is the water being paddled. If the paddle 20 in FIG. 3 were spun 180° about the main axis 40, the power face of the blade 22 would be pointed up. If the blade 22 was stiff, if the power face was flat and horizontal, and if a perfect vertical column of water was balanced on the blade 22 but only within the outline of the blade 22, then the 'geometric center of mass' 80 would be the property of that column of water.

Instead of imagining a perfect vertical column of water, imagine a one-inch thick layer of JELLO® of uniform density. If the paddle 20 in FIG. 3 were spun 180° about the main axis 40, the power face of the blade 22 would be pointed up. So similarly as above, if: —
- the blade 22 was stiff,
- the power face was flat and horizontal, and
- the one-inch thick layer JELLO® was balanced on the power face of the blade 22 but only within the outline of the blade 22, then: —
- the 'geometric center of mass' 80 would be the property of the layer of JELLO®,
  - i.e., the geometric center of mass of the JELLO® would be immediately on top of the 'geometric center of mass' 80 of the blade 22.

The 'geometric center of mass' 80 is probably close to being but is probably not exactly contained in the coronal plane (again, not indicated in FIG. 3). The 'geometric center of mass' 80 locates a load axis 82 which, when viewed in this plan view, is perpendicular to the main axis 40.

The transverse axis 52 is definitely not contained in the coronal plane (again, not indicated in FIG. 3) but in the outer plane 76 (coronal plane 72 and outer plane 76 are shown in FIGS. 7-8). Nevertheless, the transverse axis 52 which, when viewed in this plan view of FIG. 3, is perpendicular to the main axis 40.

Given the foregoing, the length "X" corresponds to the distance between the transverse axis 52 of the forearm brace 24, and, the fulcrum axis 78 of the fulcrum 68.

The length "Y" corresponds to the distance between the fulcrum axis 78 of the fulcrum 68, and, the load axis 82 of the 'geometric center of mass' 80 for the blade 22.

As said above, the paddle 20 in accordance with the invention is a short, or stubby paddle. This characterization of 'short' or stubby' can be quantified by the following expression of "Y" relative to "X": —

$$X<Y<3X. \quad (2)$$

FIGS. 9-15 show in closer detail the control handle 30 in accordance with the invention for the one-handed, forearm-braced paddle 20 in accordance with the invention. Again, the control handle 30 comprises a T-shaped structure where the stem of the T-shape comprise the goose-necked lever arm 64, and, the cross-bar of the T-shaped structure comprises the hand grip 60.

The goose-necked lever arm 64 is configured or otherwise arranged to provide clearance by a gap 66 for the user's fingers and thumb such that the user's clenched grasp on the hand grip 60 is relatively unimpeded by any of the stem portion 26, blade 22, or base portion 68 of the lever arm 64. This is shown better by FIGS. 16-21.

Figure 13:
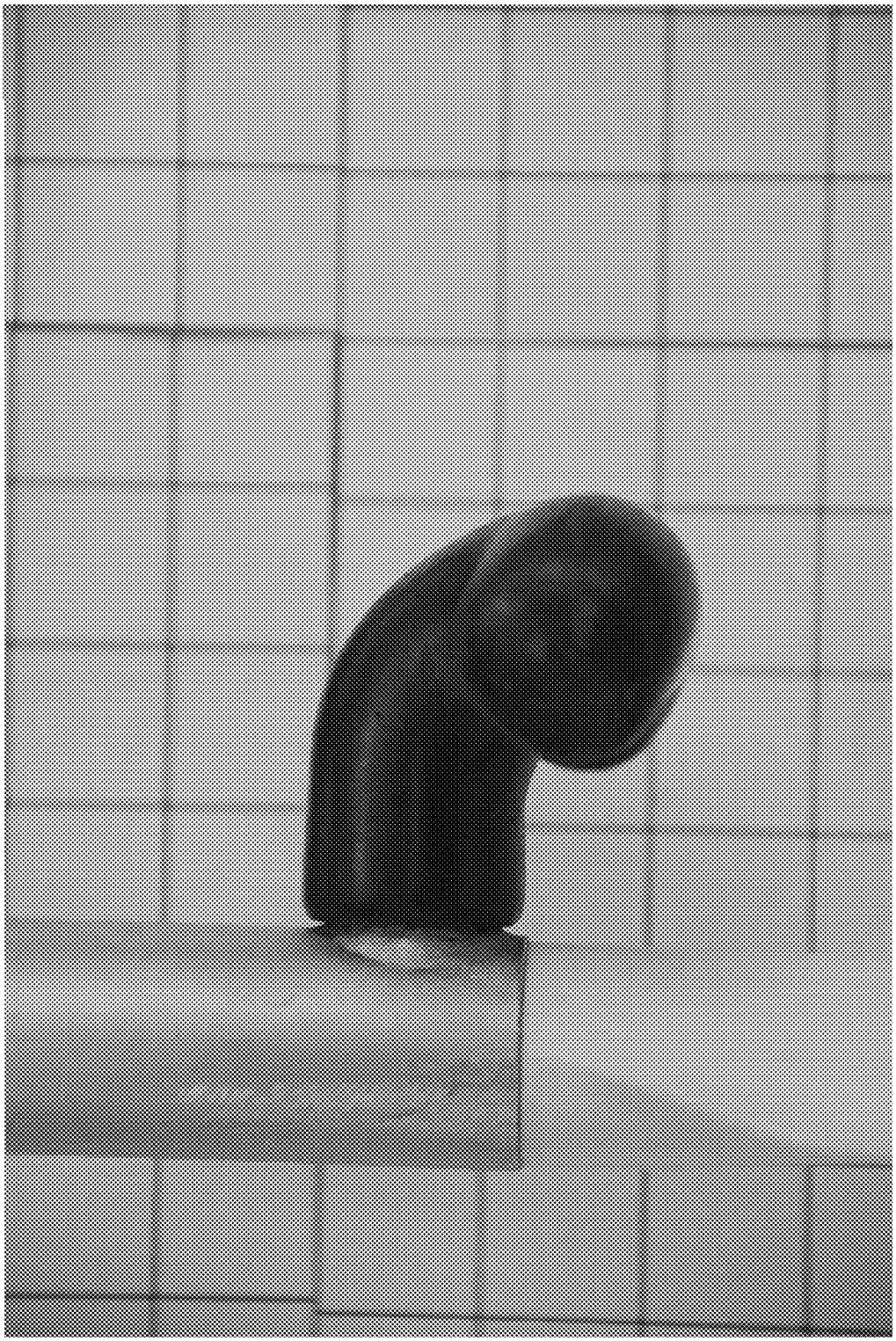
FIG. 13 is a right side elevational view thereof.

In particular, the user's fingers are not split apart by the lever arm 64. In FIG. 13, the lever arm 64 has a base end 68 which is the base of a column portion extending out of the stem 26 of the paddle 20 between the blade 22 and forearm brace 24. In other words, the base end 68 of column portion of the lever arm 64 in FIG. 13 extends from six o'clock number on an imaginary clock face to the center of the imaginary clock face. There at the center of the imaginary clock face, the column portion transitions into a curved portion that intersects the hand grip 60 at about the two o'clock number on the imaginary clock face.

That way, the user can squeeze the hand grip 60 with a strong clasp without the user's fingers being split apart by the lever arm 64. This is shown better in FIGS. 17 through 20.

It is a preferred aspect of the invention not to split apart the user's fingers. For one reason, the user can more comfortably squeeze the hand grip 60 with a strong clasp if his or her fingers are not split apart by the lever arm 64. For another reason, in real cold weather, a paddler would be less likely to merely wear gloves as shown in FIG. 23, but, more likely wear mittens (not shown).

Mittens, needless to say, will not permit a split-finger grip with an object splitting the fingers. Hence the lever arm 64 is goose-necked is configured as shown in FIG. 13 so that a user's fingers are not split when clenching the hand grip 60, as shown better in FIGS. 17 through 20.

And preferably the lever arm 64 and hand grip 60 are sized and arranged this way such that the gap 66 even provides clearance for users wearing thick gloves for cold weather paddling. This is shown better by FIG. 22. These gloves are representative and without limitation of 3 mm thick neoprene gloves. The gap 66 is advantageously spacious such that the user can release his or her grip off the control handle 30 and extract his or her hand and arm out of the paddle 20.

In an emergency, the user might want to throw or separate from the paddle 20 in an instant.

The goose-necked lever arm 64 comprises a base end 68 anchored in (or growing out of) the stem portion 26 as shown in the drawings, but could be rooted in (or grow out of) the blade 22 (e.g., proximate the leaf-shaped expansion of the blade 22 extending from said stem portion 26) or other transitional structure. The goose-necked lever arm 64 extends from the base end 68 to a T-intersection with the crosswise hand grip 60 along a curve (previously described as 'curve portion' of the lever arm 64).

Figure 9:
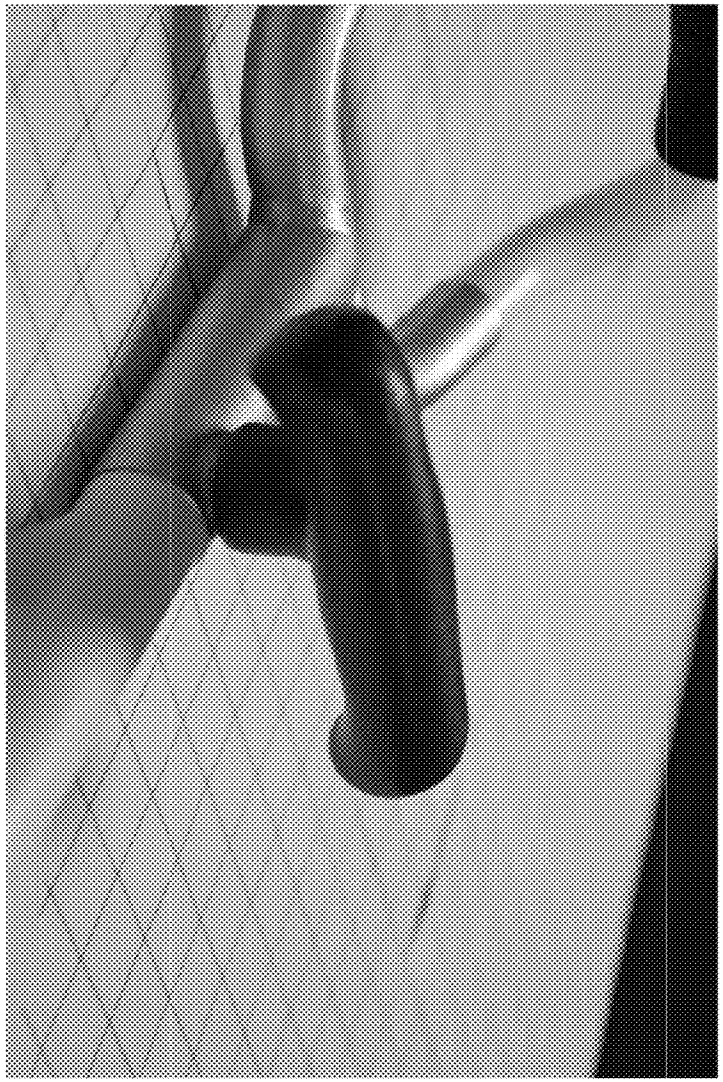
FIG. 9 is an enlarged-scale upper-right front perspective view of a control handle in accordance with the invention for the one-handed, forearm-braced paddle in accordance with the invention.
Figure 10:
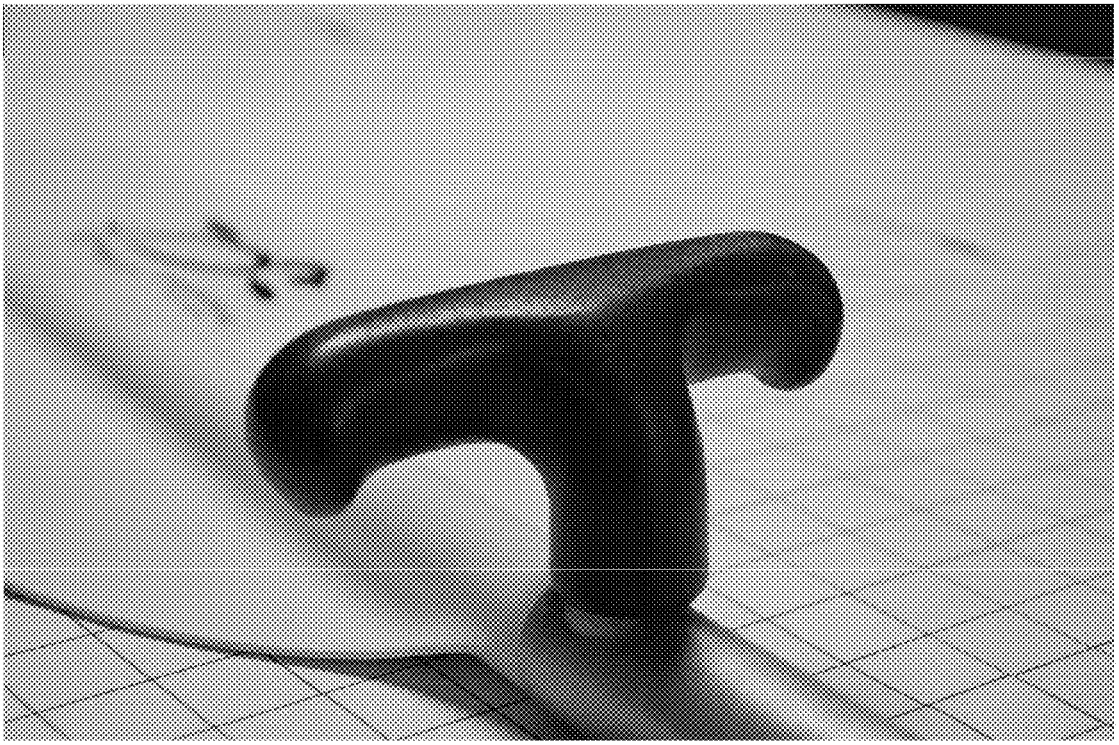
FIG. 10 is an upper-rear left perspective view thereof.

The hand grip 60 is symmetric merely for the purpose for the paddle being simultaneously a right-handed version and left-handed version at the same time. The hand grip 60 has ergonomic formations particularly at each of the opposite tip ends. With the paddle 20 upright as shown in FIGS. 9 and 10, the left tip end is ergonomically formed for serving a right thumb, and the right tip end is correspondingly ergonomically formed for serving a left thumb.

The hand grip 60 is generally cylindrical, and has a relatively substantial diameter, something meaty like the handle of a baseball bat and not slender like the handle of a golf club. It is desired that a user's grip on the hand grip 60 should be more like a powerful grip on hard-swung a baseball bat than a finesse grip as on a golf putter.

Figure 16:
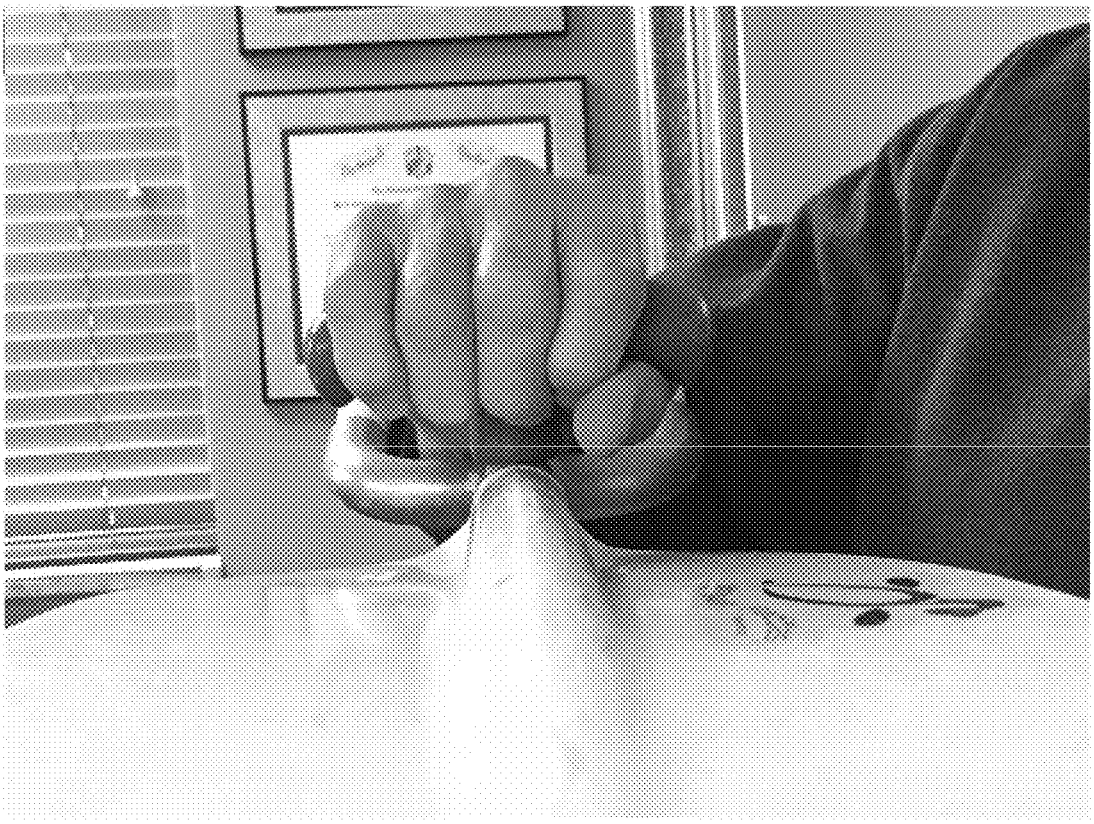
FIG. 16 is a front elevational view comparable to FIG. 11 except showing a user with a right-handed palm-down grip on the control handle.

When the user grips the hand grip 60, his or her thumb is going to be on one side or the other of the goose-necked lever arm 64. A right-handed palm-down grip as shown in FIG. 16 will have the right thumb on the left side of the goose-necked lever arm 64. It will be vice versa for a left-handed palm-down grip.

Figure 11:
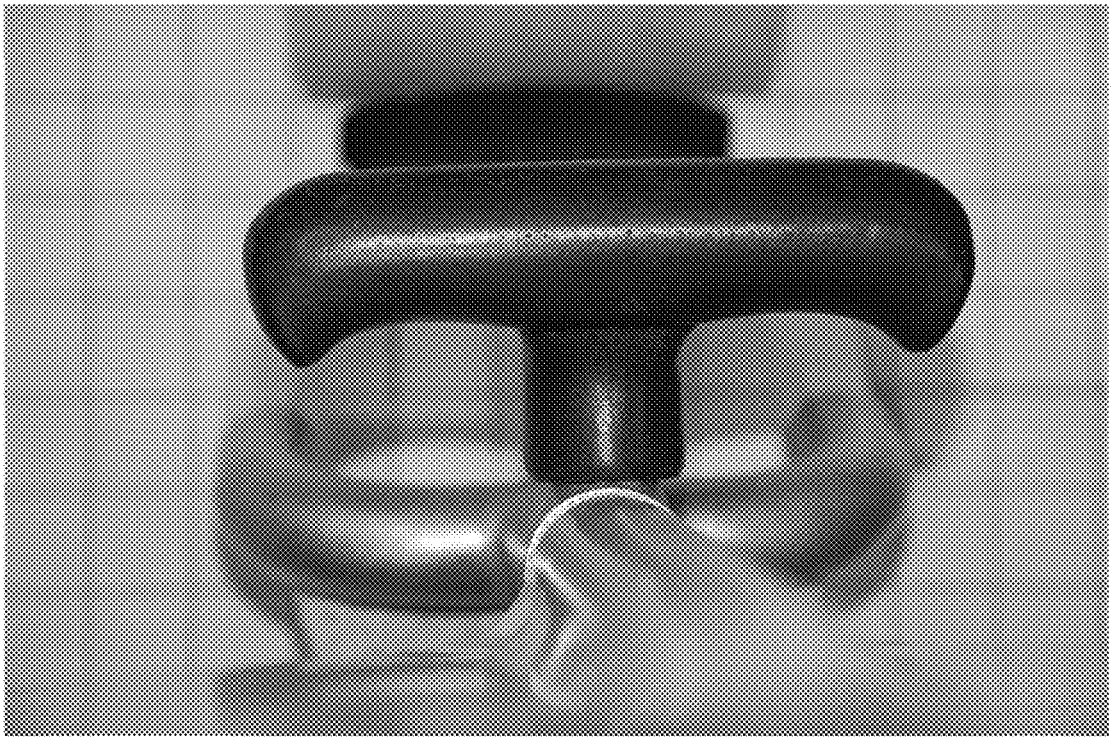
FIG. 11 is a front elevational view thereof.
Figure 12:
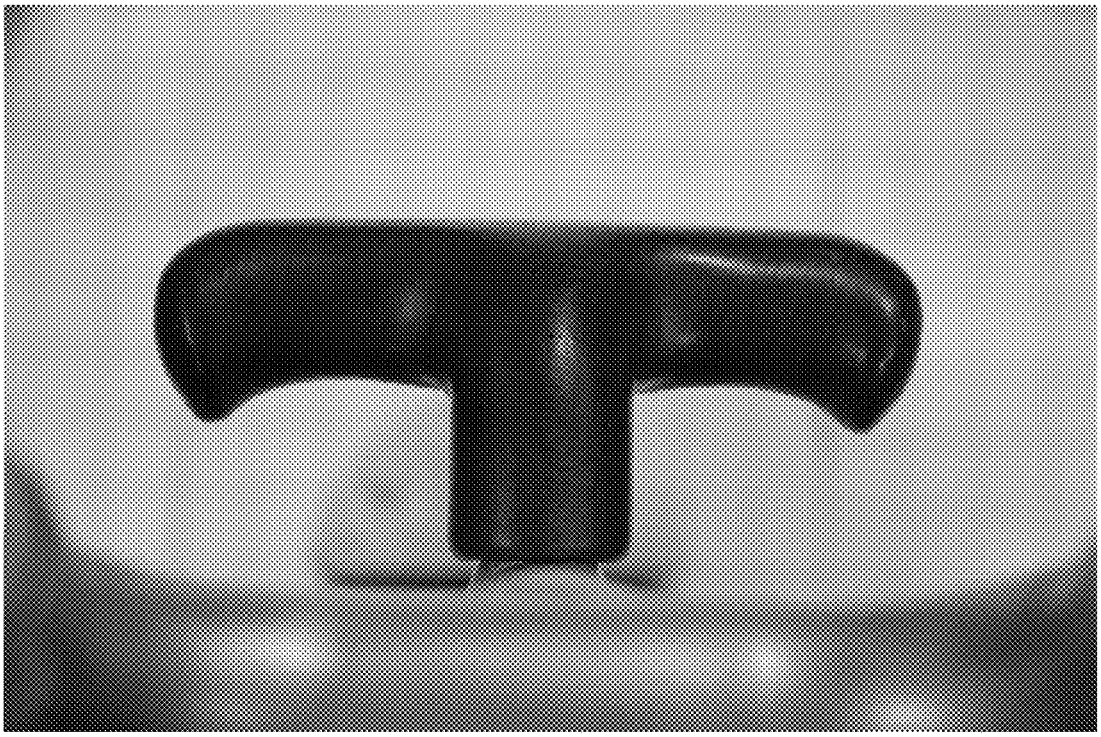
FIG. 12 is a rear elevational view thereof.
Figure 14:
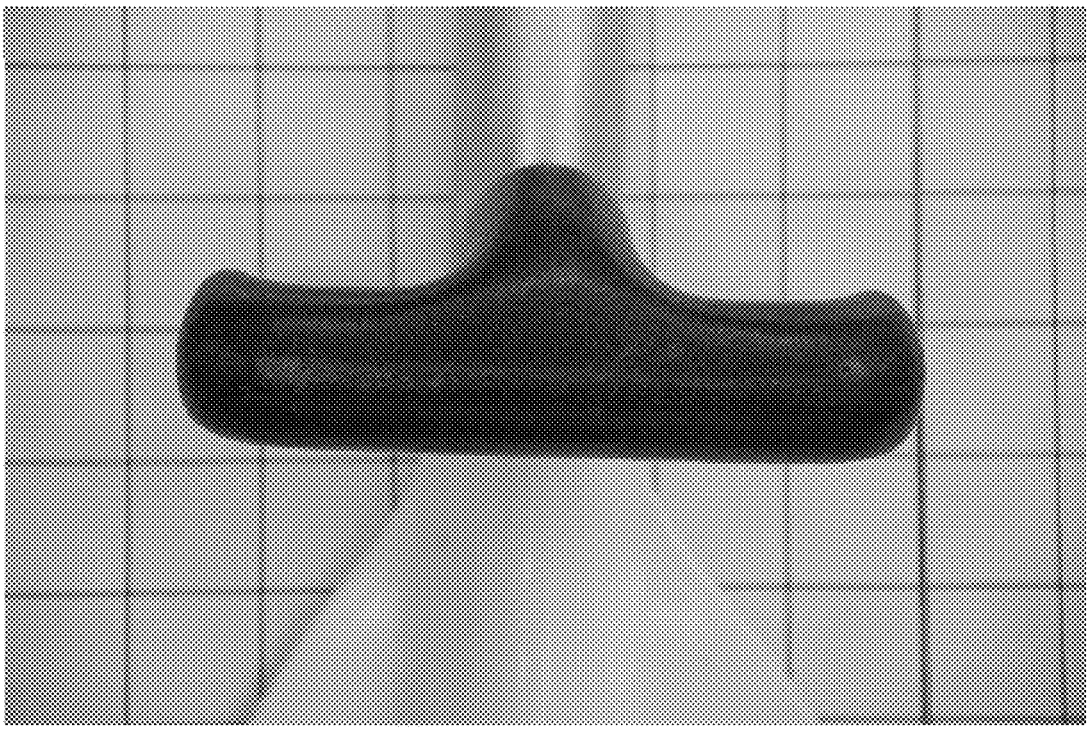
FIG. 14 is a top plan view thereof.
Figure 15:
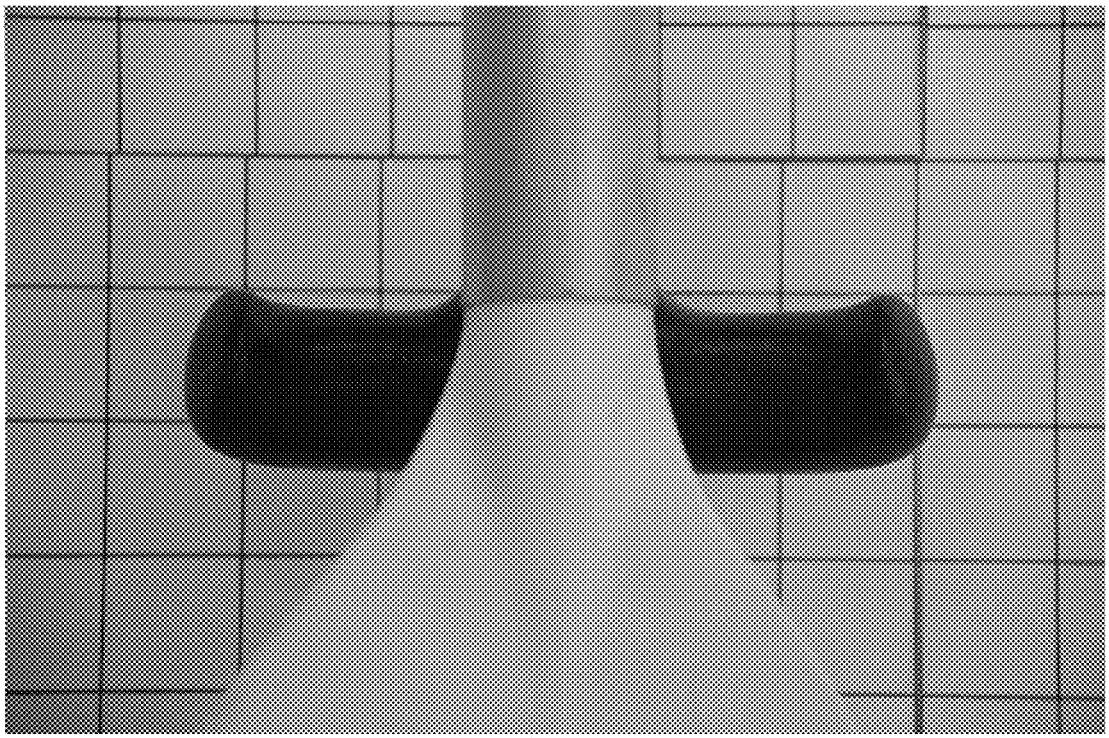
FIG. 15 is a bottom plan view thereof.

FIGS. 9-15 show that the ends of hand grip 60 have an inventive ergonomic formation. FIGS. 11 and 14 show better that the hand grip has a central cross bar portion flanked by opposite contoured, swept-back/tipped-down winglets. FIG. 13 shows that these contoured, swept-back/tipped-down winglets not only droop downwardly but also sweep back rearwardly at about and without limitation a 45° angle. In consequence, as shown pretty well in FIG. 10, these contoured, swept-back/tipped-down winglets—which are still nevertheless generally cylindrical—form inside bends. These inside bends define inside-bend thumb-engaging surfaces.

FIGS. 16-22 show the advantages of all of this. To start with, FIG. 16 shows a user with a right-handed palm-down grip on the control handle 30. The user's thumb (right thumb, needless to say) is nestled under—and in engagement with—the left-side inside-bend thumb-engaging surface.

The user's right thumb can comfortably apply a counter-clockwise applied torque into the left-side inside-bend thumb-engaging surface—to spin the paddle 30 in an axis parallel with the user's forearm. Additionally, the inside-bend thumb-engaging surface provides a minor amount of outboard support so that the user's thumb is restrained from sliding off the end. Again, this paddle 30 is preferably a kayak paddle. The hand grip 30 as well as the user's hands, gloves, mittens or the like are all going to be wet. The little extra support for outboard retention helps combat the slickness that may be due to wetness.

Figure 17:
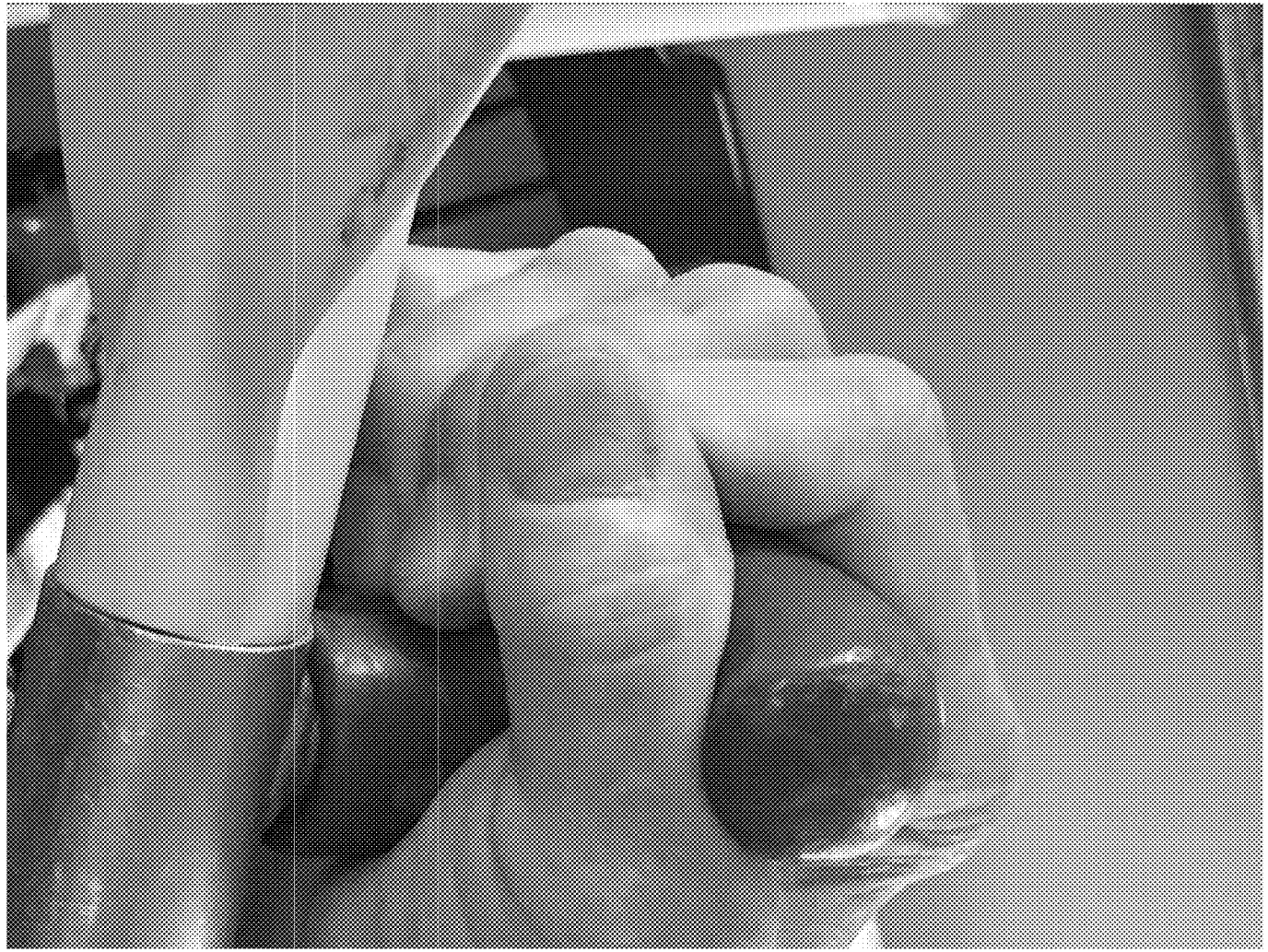
FIG. 17 is a left side perspective view somewhat comparable to FIG. 13, except below the plane of the blade, and showing the user with the same right-handed palm-down grip on the control handle as shown in FIG. 16.

FIG. 17 shows better how the diameter of the goose-necked lever arm 64 and hand grip 60 are cooperatively sized, along with the proportions of the back-stretching/drooping enlargements (i.e., where the left-side one is shown here).

The user's fingers are not split by the goose-necked lever arm 64. In contrast, the finger tips of (a) either the user's index and middle finger or (b) middle and ring finger are pressing underneath the goose-neck curved portion of the goose-necked lever arm 64. The palm portion of the user's right thumb is directly in contact with the left lateral side of the goose-neck arc portion of the goose-necked lever arm 64. FIG. 17 shows like FIG. 16 that, the user's right thumb—on the inside of between the first and second knuckle—is nestled under and in engagement with the left-side inside-bend thumb-engaging surface.

Figure 18:
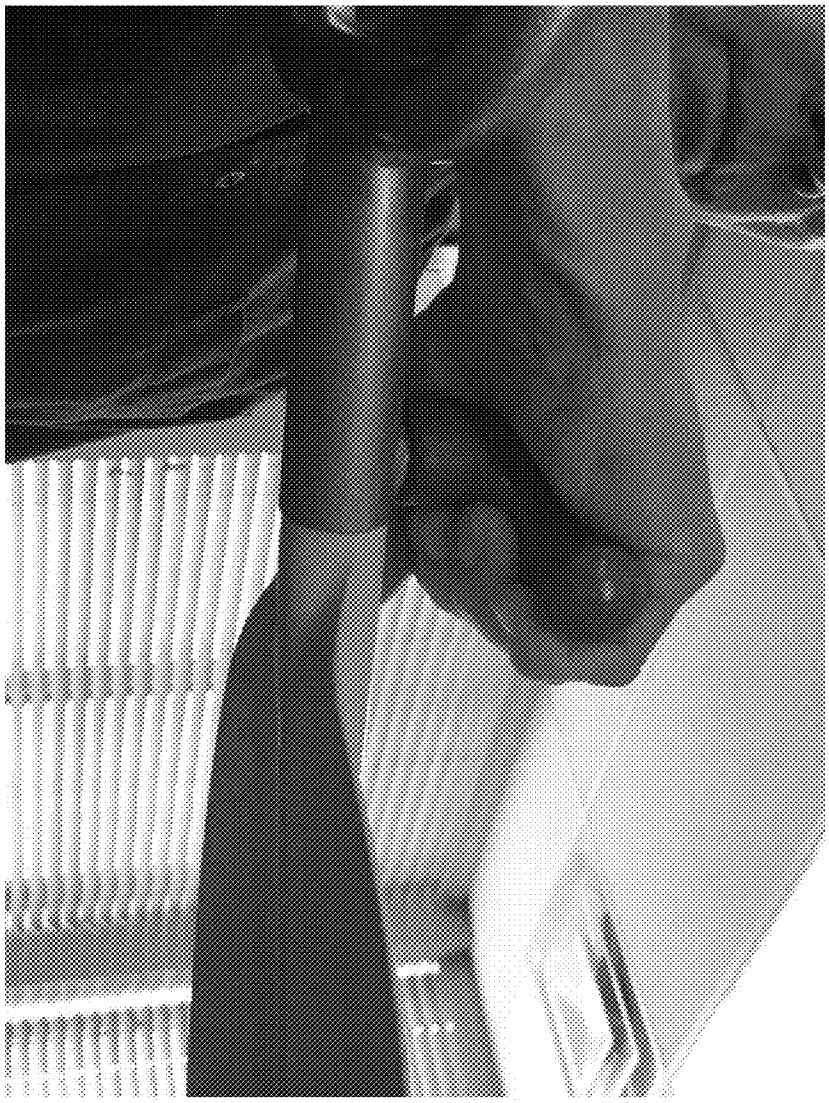
FIG. 18 is a right side perspective view in contrast to FIG. 17 but still below the plane of the blade and still showing the user with the same right-handed palm-down grip on the control handle as shown in FIGS. 16 and 17.
Figure 19:
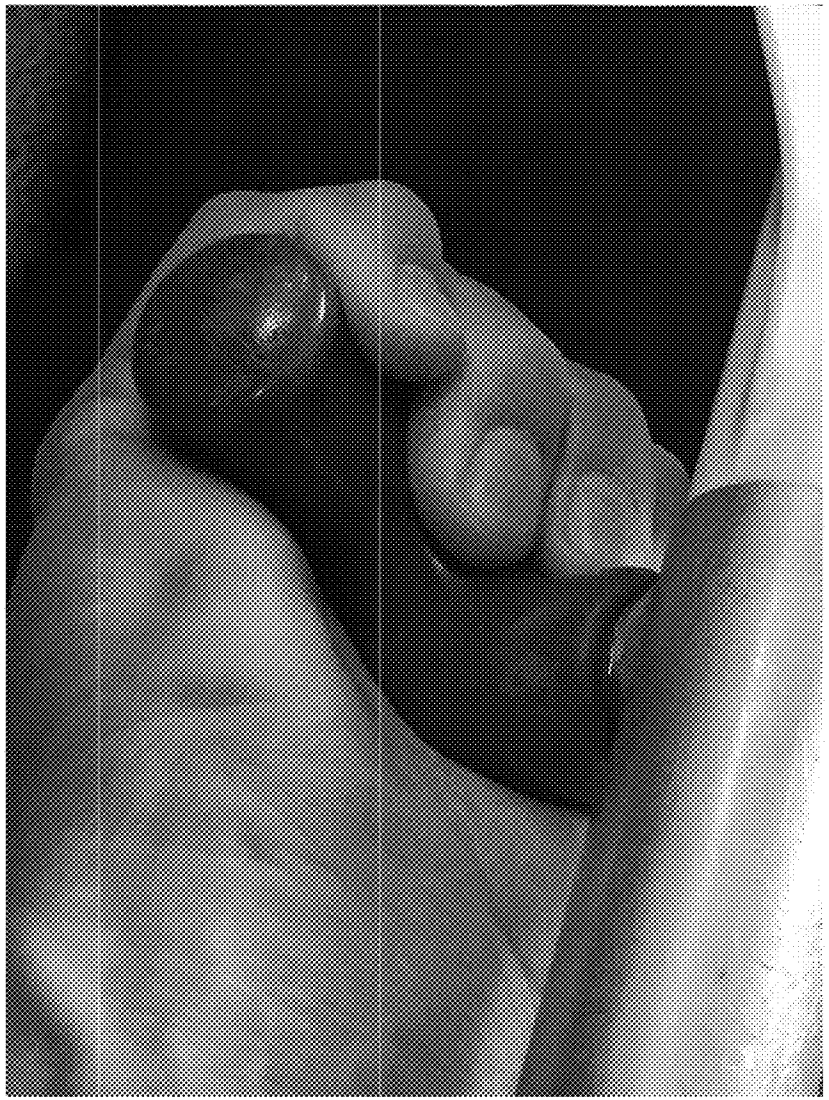
FIG. 19 is a right side perspective view comparable to FIG. 18, except wherein the user has spun the paddle 180° about the user's right forearm such that the user's right-handed grip is now palm facing up.
Figure 20:
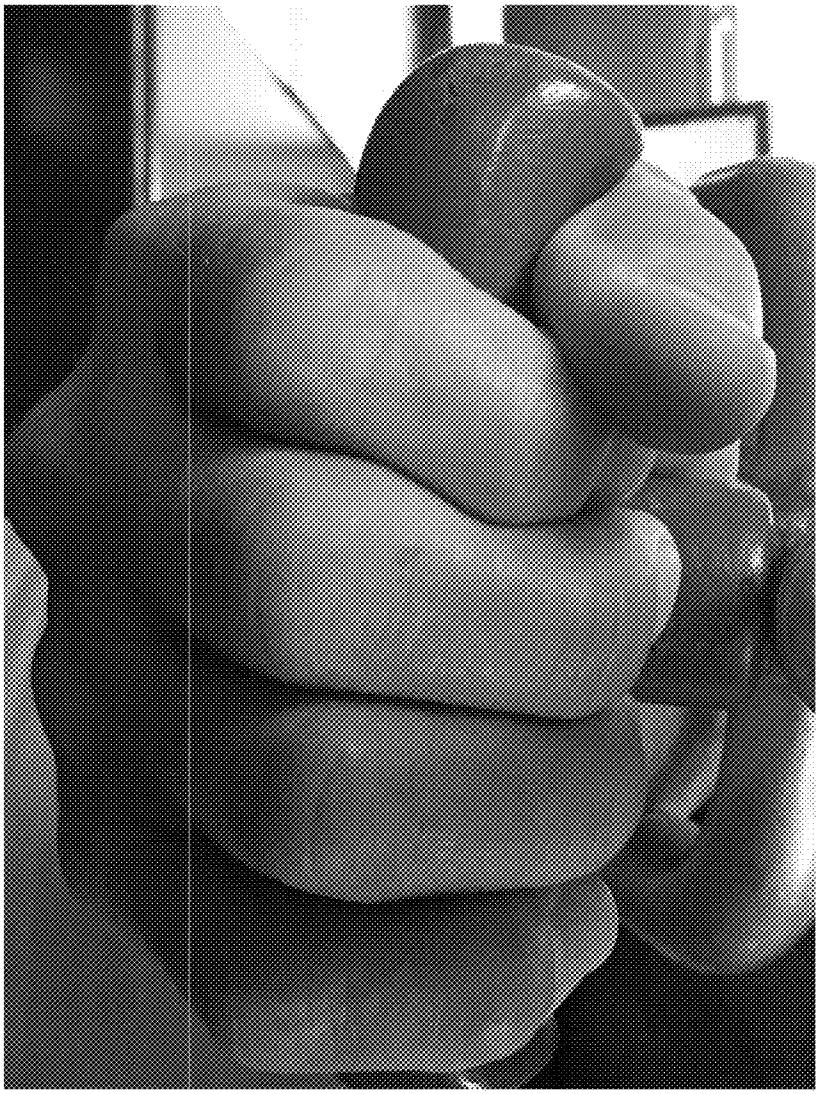
FIG. 20 is a front elevational view of FIG. 19.

FIGS. 18-20 furthermore shows that the user's fingers are not split apart in the user's grip on the hand grip 60 by virtue of the chosen shape and proportions of the goose-neck portion of the goose-necked lever arm 64.

Figure 21:
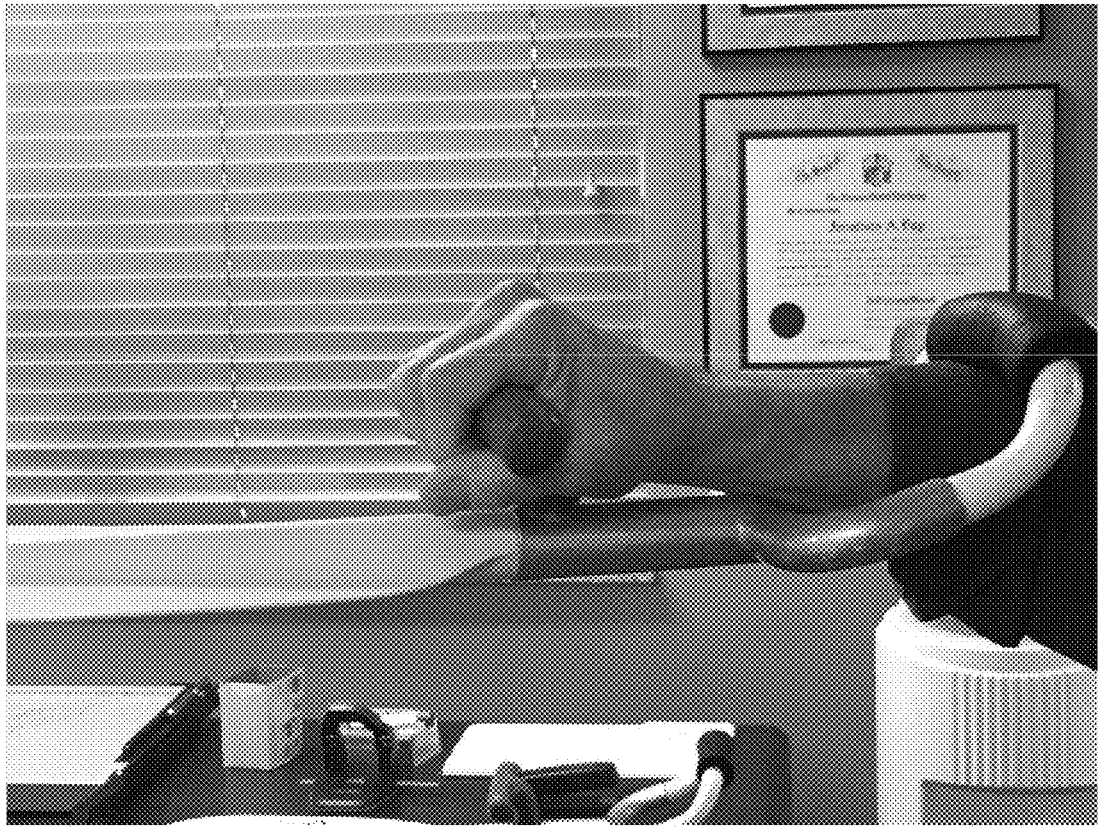
FIG. 21 is a wider-angle left side perspective view of FIG. 17, thereby including the forearm brace in the view as well.

FIG. 21 is a view from a more distant vantage point than the close-up views of FIGS. 9-20 to reiterate the following. The shape and proportions of various aspects of the control handle 30 are meant to contribute to—not just torque about an axis through the user's shoulders for a forward paddle stroke, but also as well—to a twisting stroke about an axis through the user's forearm for (among other strokes) a back-ferry.

Returning to FIGS. 16 and 17, the inside of between the first and second knuckle of the user's right thumb is nestled under and in engagement with the left-side inside-bend thumb-engaging surface of the hand grip 60 of the control handle 30, in order to provide the following. That is, in order to allow the user to apply a stronger counterclockwise twisting stroke (i.e., counterclockwise relative to FIGS. 16 and 17).

Conversely, the palm portion of the user's right thumb is in engagement with the left lateral side of the goose-neck arc portion of the goose-necked lever arm 64, in order to provide the following. That is, in order to allow the user to apply a stronger clockwise twisting stroke (i.e., clockwise relative to FIGS. 16 and 17).

Figure 22:
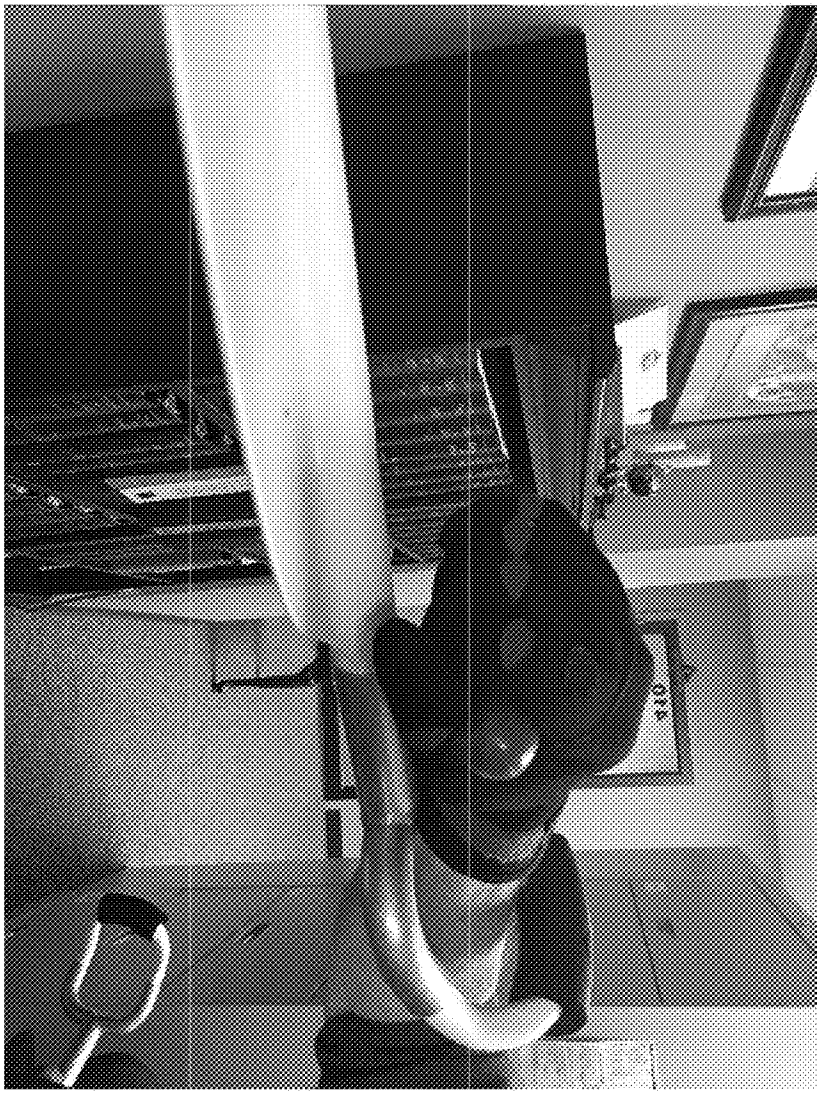
FIG. 22 is a upper-left front perspective view in contrast to FIG. 9 which is an upper-right (not left) perspective view, except wherein a user has a right-handed palm-down grip on the control handle, and, is wearing a three millimeter (3 mm) thick neoprene glove.

FIG. 22 shows that the above ergonomic formations can be engaged by the user even when wearing thick gloves, including without limitation three millimeter (3 mm) thick neoprene gloves.

FIG. 22 shows a further aspect of the invention. The framing 50 is greatly oversized for the user's forearm to rattle around in. The framing 50 comprises a pair of spaced left and right side rails spaced at the rear by the forearm brace 24. This forearm brace 24, which as FIG. 21 shows, is actually what engages the posterior aspect of the user's forearm. To return to FIG. 22, the forearm brace 24 has a slight curve to it so the user's forearm is more or less centered under the forearm brace 24. But the user's forearm is not half or a third encircled by the forearm brace 24. In contrast, the arc width of engagement between the forearm brace 24 and the posterior aspect of the user's forearm is a relatively small arc width.

The arc width of engagement between the forearm brace 24 and the posterior aspect of the user's forearm is preferably much less than 45°.

Again, when the user wants to throw the paddle 20 (say for example to be free to swim away at any time) the user will surely want to be free of the paddle 20 in a hurry.

The framing 50 and control handle 30 all have an oversized geometry, and generously rounded corners and otherwise generously rounded or smooth configurations, to allow separation in a hurry. It is an aspect of the invention that framing 50 and control handle 30 are free of snagging formations.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A one-handed, forearm-braced paddle (20), comprising:

transitional structure (26) elongated along a main axis (40) and extending between a proximal transition (42) and a spaced distal transition (44);

a blade (22) extending from the distal transition (44);

a forearm brace (24) for sustaining pressure applied thereto from the anatomical posterior aspect (32) of a user's forearm;

rigid framing (50) fixed to the proximal transition (42) of the transitional structure (26) and extending along the user's forearm to interconnect the forearm brace (24) with the proximal transition (42); and a T-shaped control handle (30) comprising a hand grip (60) elongated along a grip axis (62) between spaced ends and arranged generally transverse to the main axis (40), and, further comprising a fixed lever arm (64) interconnecting the hand grip (60) with one of the transitional structure (26) or blade (22) proximate the distal transition (44);

wherein one of said ends is formed with an ergonomic formation providing an inside-bend thumb-engaging surface thereby reducing slippage of a wet thumb off the handle and assisting twisting torque on the control handle; and wherein the lever arm (64) is configured to support the hand grip (60) radially spaced away from the main axis (40) such that said user's clenched grasp on the hand grip (60) is spaced off the transitional structure (26) by a gap (66);

said hand grip (60) is sized to allow the user to coil fingers and thumb therearound; and the lever arm (64) is sized such that the gap (66) over the transitional structure (26) provides clearance for the user's fingers to coil around said hand grip (60) while wearing three millimeter thick gloves and thereby avoid impedance from the transitional structure (26).

2. The one-handed, forearm-braced paddle (20) of claim 1 further comprising:

wherein each of said ends is formed with an ergonomic formation providing an inside-bend thumb-engaging surface.

3. The one-handed, forearm-braced paddle (20) of claim 1 wherein:

said ergonomic formation comprises a contoured, swept-back/tipped-down winglet that not only droops downwardly but also sweeps back rearwardly.

4. The one-handed, forearm-braced paddle (20) of claim 1 wherein:

said ergonomic formation comprises a contoured, swept-back/tipped-down winglet that not only droops downwardly but also sweeps back rearwardly at about a 45° angle.

5. The one-handed, forearm-braced paddle (20) of claim 1 wherein:

the forearm brace (24) is elongated along a transverse axis (52) generally transverse to the main axis (40);

the control handle (30) is connected to the transitional structure (26) at a fulcrum (68) which locates a fulcrum axis (78) parallel to the transverse axis (52);

the blade (22) has geometric center of mass (80) which locates a load axis (82) parallel to the transverse axis (52); and said paddle being configured such that the distance between the load axis (82) and fulcrum axis (78) is one to three times the distance between the fulcrum axis (78) and transverse axis (52).

6. The one-handed, forearm-braced paddle (20) of claim 1 wherein:

the framing (50) is configured to dispose the forearm brace (24) intermediate between the user's wrist and elbow while clenching the hand grip (60).

7. The one-handed, forearm-braced paddle (20) of claim 1 wherein:

said transitional structure (26) comprises a stem portion (26) elongated along a main axis (40) and extending between the proximal transition (42) and the distal transition (44).

8. The one-handed, forearm-braced paddle (20) of claim 1 wherein:

the blade (22) comprises a leaf-shaped expansion extending from said transitional structure (26) and generally relative to a coronal plane (72) for the blade (22), which coronal plane (72) contains the main axis (40); and the blade (22) is either flat or warped, and if the blade (22) is warped, then the warp has either coincidence with or divergence away from the coronal plane (72) over the expansion of the blade (22), wherein the divergence away from the coronal plane (72) is minor relative to the leaf-shaped expansion of the blade (22) from the transitional structure (26).

9. The one-handed, forearm-braced paddle (20) of claim 8 wherein:

the forearm brace (24) is elongated along a transverse axis (52) generally transverse to the main axis (40);

the control handle (30) is connected to the transitional structure (26) at a fulcrum (68) which locates a fulcrum axis (78) parallel to the transverse axis (52);

the blade (22) has geometric center of mass (80) which locates a load axis (82) parallel to the transverse axis (52); and said paddle being configured such that the distance between the load axis (82) and fulcrum axis (78) is one to three times the distance between the fulcrum axis (78) and transverse axis (52).

10. A one-handed, forearm-braced paddle (20), comprising:

transitional structure (26) elongated along a main axis (40) and extending between a proximal transition (42) and a spaced distal transition (44);

a blade (22) extending from the distal transition (44);

a forearm brace (24) for sustaining pressure applied thereto from the anatomical posterior aspect (32) of a user's forearm;

rigid framing (50) fixed to the proximal transition (42) of the transitional structure (26) and extending along the user's forearm to interconnect the forearm brace (24) with the proximal transition (42);

a T-shaped control handle (30) comprising a hand grip (60) elongated along a grip axis (62) between spaced ends and arranged generally transverse to the main axis (40), and, further comprising a fixed lever arm (64) interconnecting the hand grip (60) with one of the transitional structure (26) or blade (22) proximate the distal transition (44); and said lever arm (64) having a base end (68) in the transitional structure (26), a column portion extending out of the base end (68) which transitions into a curved portion that intersects the hand grip (60);

wherein said column portion, curved portion and hand grip (60) are sized and proportioned such that the user can clasp the hand grip (60) with fingers closed and not split apart by the lever arm (64), whereby the user can clench the hand grip (60) wearing mittens.

11. The one-handed, forearm-braced paddle (20) of claim 10 wherein:

one of said ends of the hand grip (60) is formed with an ergonomic formation providing an inside-bend thumb-engaging surface thereby reducing slippage of a wet thumb off the handle and assisting twisting torque on the control handle.

12. The one-handed, forearm-braced paddle (20) of claim 11 wherein:

said ergonomic formation comprises a contoured, swept-back/tipped-down winglet that not only droops downwardly but also sweeps back rearwardly.

13. The one-handed, forearm-braced paddle (20) of claim 10 wherein:

the forearm brace (24) is elongated along a transverse axis (52) generally transverse to the main axis (40);

the control handle (30) is connected to the transitional structure (26) at a fulcrum (68) which locates a fulcrum axis (78) parallel to the transverse axis (52);

the blade (22) has geometric center of mass (80) which locates a load axis (82) parallel to the transverse axis (52); and said paddle being configured such that the distance between the load axis (82) and fulcrum axis (78) is one to three times the distance between the fulcrum axis (78) and transverse axis (52).

14. The one-handed, forearm-braced paddle (20) of claim 10 wherein:

the framing (50) is configured to dispose the forearm brace (24) intermediate between the user's wrist and elbow while clenching the hand grip (60).

15. The one-handed, forearm-braced paddle (20) of claim 10 wherein:

said transitional structure (26) comprises a stem portion (26) elongated along a main axis (40) and extending between the proximal transition (42) and the distal transition (44).

16. The one-handed, forearm-braced paddle (20) of claim 10 wherein:

wherein the lever arm (64) is configured to support the hand grip (60) radially spaced away from the main axis (40) such that said user's clenched grasp on the hand grip (60) is spaced off the transitional structure (26) by a gap (66).

said hand grip (60) is sized to allow the user to coil fingers and thumb therearound; and the lever arm (64) is sized such that the gap (66) over the transitional structure (26) provides clearance for the user's fingers to coil around said hand grip (60) while wearing three millimeter thick gloves and thereby avoid impedance from the transitional structure (26).

17. The one-handed, forearm-braced paddle (20) of claim 10 wherein:

the blade (22) comprises a leaf-shaped expansion extending from said transitional structure (26) and generally relative to a coronal plane (72) for the blade (22), which coronal plane (72) contains the main axis (40); and the blade (22) is either flat or warped, and if the blade (22) is warped, then the warp has either coincidence with or divergence away from the coronal plane (72) over the expansion of the blade (22), wherein the divergence away from the coronal plane (72) is minor relative to the leaf-shaped expansion of the blade (22) from the transitional structure (26).

18. The one-handed, forearm-braced paddle (20) of claim 17 wherein:

the forearm brace (24) is elongated along a transverse axis (52) generally transverse to the main axis (40);

the control handle (30) is connected to the transitional structure (26) at a fulcrum (68) which locates a fulcrum axis (78) parallel to the transverse axis (52);

the blade (22) has geometric center of mass (80) which locates a load axis (82) parallel to the transverse axis (52); and said paddle being configured such that the distance between the load axis (82) and fulcrum axis (78) is one to three times the distance between the fulcrum axis (78) and transverse axis (52).

19. A one-handed, forearm-braced paddle (20), comprising:

transitional structure (26) elongated along a main axis (40) and extending between a proximal transition (42) and a spaced distal transition (44);

a blade (22) extending from the distal transition (44);

a forearm brace (24) for sustaining pressure applied thereto from the anatomical posterior aspect (32) of a user's forearm;

rigid framing (50) fixed to the proximal transition (42) of the transitional structure (26) and extending along the user's forearm to interconnect the forearm brace (24) with the proximal transition (42); and a T-shaped control handle (30) comprising a hand grip (60) elongated along a grip axis (62) between spaced ends and arranged generally transverse to the main axis (40), and, further comprising a fixed lever arm (64) interconnecting the hand grip (60) with one of the transitional structure (26) or blade (22) proximate the distal transition (44);

the control handle (30)'s lever arm (64) supports the hand grip (60) such that the grip axis (62) therefor is radially spaced away from the main axis (40) along one radially perpendicular distance perpendicular to the coronal plane (72); and the framing (50) is arranged to support the forearm brace (24) such that the transverse axis (52) for the forearm brace (24) is radially spaced away from the main axis (40) along another radially perpendicular distance perpendicular to the coronal plane (72);

wherein said one radially perpendicular distance between the main axis (40) and the grip axis (62) is at least ninety percent less than said other radially perpendicular distance between the main axis (40) and transverse axis.

20. The one-handed, forearm-braced paddle (20) of claim 19 wherein:

wherein said one radially perpendicular distance between the main axis (40) and the grip axis (62) is at least eighty percent less than said other radially perpendicular distance between the main axis (40) and transverse axis.

21. The one-handed, forearm-braced paddle (20) of claim 19 wherein:

said framing (50) extends along either the anatomical lateral aspect of the user's forearm or the anatomical medial aspect of the user's forearm.

22. The one-handed, forearm-braced paddle (20) of claim 19 wherein:

the lever arm (64) comprises a gooseneck shape that arches out of the transitional structure (26) and away from the forearm brace (24), and scaled and proportioned so that a user's fingers can coil around the hand grip (60) and not be split by the gooseneck-shaped lever arm (64) whereby the user tightly grasp the hand grip (60) wearing mittens.

23. The one-handed, forearm-braced paddle (20) of claim 19 wherein:

said hand grip (60) is shaped and sized to allow the user to clench fingers therearound along a grip axis (62) that is contained in a plane (74) that is spaced from and parallel to the coronal plane (72); and the control handle (30) is configured to allow the user's fingers to the clench around the hand grip (60) through a gap (66) between the hand grip (60) and the transitional structure (26) or blade (22) without impedance from either the transitional structure (26) or the blade (22) proximate the distal transition (44).

24. The one-handed, forearm-braced paddle (20) of claim 19 wherein:

one of said ends of the hand grip (60) is formed with an ergonomic formation providing an inside-bend thumb-engaging surface thereby reducing slippage of a wet thumb off the handle and assisting twisting torque on the control handle.

25. The one-handed, forearm-braced paddle (20) of claim 24 wherein:

said ergonomic formation comprises a contoured, swept-back/tipped-down winglet that not only droops downwardly but also sweeps back rearwardly.

26. The one-handed, forearm-braced paddle (20) of claim 24 wherein:

said ergonomic formation comprises a contoured, swept-back/tipped-down winglet that not only droops downwardly but also sweeps back rearwardly at about a 45° angle.

27. The one-handed, forearm-braced paddle (20) of claim 24 wherein:

said lever arm (64) has a base end (68) in the transitional structure (26), a column portion extending out of the base end (68) which transitions into a curved portion that intersects the hand grip (60);

wherein said column portion, curved portion and hand grip (60) are sized and proportioned such that the user can clasp the hand grip (60) with fingers closed and not split apart by the lever arm (64), whereby the user can clench the hand grip (60) wearing mittens.

* * * * *